US012312111B2

(12) United States Patent
Foley et al.

(10) Patent No.: US 12,312,111 B2
(45) Date of Patent: May 27, 2025

(54) METHOD FOR PROVIDING AT LEAST ONE UTENSIL WRAPPED IN A NAPKIN, APPARATUS FOR WRAPPING A NAPKIN AROUND AT LEAST ONE UTENSIL, UTENSIL PICKER AND MAGAZINE FOR STORING UTENSILS

(71) Applicants: Kevin Foley, Encinitas, CA (US); Michael D. Foley, Cambridge, MA (US); Esko Heilner, Portland, ME (US)

(72) Inventors: Kevin Foley, Encinitas, CA (US); Michael D. Foley, Cambridge, MA (US); Esko Heilner, Portland, ME (US)

(73) Assignee: LEFT FIELD PRODUCTS LLC, Encinitas, CA (US)

( * ) Notice: Subject to any disclaimer, the term of this patent is extended or adjusted under 35 U.S.C. 154(b) by 13 days.

(21) Appl. No.: 18/252,663

(22) PCT Filed: Nov. 11, 2021

(86) PCT No.: PCT/IB2021/060469

§ 371 (c)(1),
(2) Date: May 11, 2023

(87) PCT Pub. No.: WO2022/101830

PCT Pub. Date: May 19, 2022

(65) Prior Publication Data

US 2024/0002086 A1 Jan. 4, 2024

Related U.S. Application Data

(60) Provisional application No. 63/112,392, filed on Nov. 11, 2020.

(51) Int. Cl.
*B65B 11/04* (2006.01)
*B65B 11/56* (2006.01)
(Continued)

(52) U.S. Cl.
CPC ..... *B65B 11/56* (2013.01); *B65B 11/04* (2013.01); *B65B 35/16* (2013.01); *B65B 41/06* (2013.01);
(Continued)

(58) Field of Classification Search
CPC ..... B65B 11/04; B65B 11/56; B65B 35/16; B65B 35/36; B65B 41/06; B65B 67/10; B65B 2220/14
(Continued)

(56) References Cited

U.S. PATENT DOCUMENTS 2,048,042 A * 7/1936 Wedge ..... B65B 25/02 53/465
5,469,688 A 11/1995 Dunbar et al.
(Continued)

FOREIGN PATENT DOCUMENTS

BE 1016123 A5 * 3/2006 ..... B65B 11/04
DE 4124239 A1 * 9/1992 ..... B65B 11/04
(Continued)

OTHER PUBLICATIONS

International Search Report and Written Opinion issued in corresponding International application No. PCT/IB2021/060469 on Feb. 25, 2022.
(Continued)

*Primary Examiner* — Stephen F. Gerrity
(74) *Attorney, Agent, or Firm* — BCF LLP

(57) ABSTRACT

A method for providing at least one utensil wrapped in a napkin is provided. The method includes placing the napkin on a wrapping assembly having first, second and third rollers and an endless belt wrapped around the rollers, in an initial configuration, placing the at least one utensil on the napkin, moving the second roller toward the first roller, turning the endless belt around rollers, stopping to turn the endless belt,
(Continued)

and returning the wrapping assembly to the initial configuration. An apparatus for wrapping a napkin around at least one utensil, a utensil picker for picking up at least one utensil from at least one utensil magazine storing a plurality of utensils, an apparatus having the utensil picker, a magazine for storing a plurality of utensils and an apparatus having the magazine are also disclosed.

20 Claims, 26 Drawing Sheets

(51) Int. Cl.
*B65B 35/16* (2006.01)
*B65B 35/36* (2006.01)
*B65B 41/06* (2006.01)
*B65B 67/10* (2006.01)

(52) U.S. Cl.
CPC ..... *B65B 67/10* (2013.01); *B65B 35/36* (2013.01); *B65B 2220/14* (2013.01)

(58) Field of Classification Search
USPC ..... 53/465, 210, 211, 215, 216
See application file for complete search history.

(56) References Cited

U.S. PATENT DOCUMENTS

| | | | | |
|---|---|---|---|---|
| 6,023,908 | A * | 2/2000 | Vetsch | B65B 11/04 53/215 |
| 6,918,226 | B2 | 7/2005 | Heilman et al. | |
| 7,210,279 | B1 | 5/2007 | Ahmed et al. | |
| 7,322,172 | B2 | 1/2008 | Hoffman et al. | |
| 9,446,870 | B1 | 9/2016 | Cameron et al. | |
| 2002/0124534 | A1 | 9/2002 | Heisey | |
| 2004/0237475 | A1 | 12/2004 | Rubin | |
| 2005/0000191 | A1 | 1/2005 | Heilman et al. | |
| 2005/0166548 | A1 | 8/2005 | Lavi | |
| 2006/0032191 | A1 | 2/2006 | Heilman et al. | |
| 2007/0271879 | A1 | 11/2007 | Hoffman et al. | |
| 2008/0000855 | A1 | 1/2008 | Rubin | |
| 2012/0048784 | A1 | 3/2012 | Chaganos | |
| 2014/0054205 | A1 | 2/2014 | Chaganos | |
| 2015/0321775 | A1 | 11/2015 | Beck | |
| 2019/0047731 | A1 | 2/2019 | Kretchman et al. | |

FOREIGN PATENT DOCUMENTS

| | | | | |
|---|---|---|---|---|
| EP | 0454202 | B1 * | 7/1994 | A22C 7/00 |
| EP | 0841247 | A1 * | 5/1998 | B65B 11/04 |
| EP | 2310295 | A1 | 4/2011 | |
| FR | 2693165 | A1 * | 1/1994 | B65B 21/26 |
| FR | 2741322 | A1 | 5/1997 | |
| JP | 02098508 | A * | 4/1990 | |
| JP | 06122416 | A * | 5/1994 | |
| KR | 20070026395 | A | 3/2007 | |
| WO | 9708052 | A1 | 3/1997 | |
| WO | 2010008774 | A1 | 1/2010 | |

OTHER PUBLICATIONS

Extended European Search Report issued by the European Patent Office (EPO) on Sep. 5, 2024 in connection with European patent application No. 21891338.2, 8 pages.

* cited by examiner

METHOD FOR PROVIDING AT LEAST ONE UTENSIL WRAPPED IN A NAPKIN, APPARATUS FOR WRAPPING A NAPKIN AROUND AT LEAST ONE UTENSIL, UTENSIL PICKER AND MAGAZINE FOR STORING UTENSILS

CROSS-REFERENCE

The present application claims priority to U.S. Provisional Patent Application No. 63/112,392 filed Nov. 11, 2020, which is incorporated by reference herein in its entirety.

TECHNOLOGICAL FIELD

The present technology relates to a method for providing at least one utensil wrapped in a napkin, an apparatus for wrapping a napkin around at least one utensil, a utensil picker for picking up at least one utensil from at least one utensil magazine storing a plurality of utensils, and a magazine for storing utensils.

BACKGROUND

Many establishments where food is served such as restaurants, cruise lines, and hospitals provide utensils that are wrapped in a napkin. Wrapping utensils in napkins can help accelerate the distribution of utensils and can help reduce contamination thereof.

Typically, utensils are manually wrapped in a napkin. This manual process can be time consuming, and when performed in commercial settings, can increase operational costs. In addition, the utensils being wrapped could be contaminated by the person manually wrapping them.

Therefore, there is a desire for an apparatus and associated components that can wrap utensils in napkins.

SUMMARY

It is an object of the present technology to ameliorate at least some of the inconveniences present in the prior art.

According to one aspect of the present technology, there is provided a method for providing at least one utensil wrapped in a napkin. The method includes placing the napkin on a wrapping assembly in an initial configuration. The wrapping assembly includes a frame first roller, a second roller, a third roller being vertically lower than the first and second roller; and an endless belt wrapped around the first, second and third rollers. The first, second and third roller are mounted to the frame. In the initial configuration, the first roller is generally vertically aligned with the second roller, and the endless belt is in tension about the first, second and third rollers. The napkin is placed on a portion of the endless belt extending between the first and second rollers. After placing the napkin on the wrapping assembly, the method includes placing the at least one utensil on the napkin. After placing the at least one utensil on the napkin, the method includes moving the second roller toward the first roller, thereby causing the endless belt to sag between the first and second rollers, and causing the napkin and the at least one utensil to be received in a resulting sag. After moving the second roller toward the first roller, the method includes turning the endless belt around the first, second and third rollers thereby wrapping the napkin around the at least one utensil. Once the at least one utensil is wrapped in the napkin, the method including stopping to turn the endless belt, and after stopping to turn the endless belt, returning the wrapping assembly to the initial configuration by moving the second roller away from the first roller, thereby causing the at least one utensil wrapped in the napkin to be disposed on the portion of the endless belt extending between the first and second roller.

In some embodiments, placing the at least one utensil on the napkin includes placing a plurality of utensils on the napkin.

In some embodiments, turning the endless belt around the first, second and third rollers includes rotating the third roller to drive the endless belt.

In some embodiments, the second roller is moved toward and away from the first roller about an arcuate path.

In some embodiments, the method further includes, after placing the at least one utensil on the napkin and before turning the endless belt around the first, second and third rollers, lifting the third roller thereby also causing the endless belt to sag between the first and second rollers, and also causing the napkin and the at least one utensil to be received in the resulting sag. The method also includes lowering the third roller when returning the wrapping assembly to the initial configuration.

In some embodiments, the method further includes, after moving the second roller toward the first roller and before turning the endless belt around the first, second and third rollers, lowering the third roller to increase tension in the endless track.

In some embodiments, the third roller is lifted and lowered about an arcuate path.

In some embodiments, the second roller is moved toward and away from the first roller about a rectilinear path.

In some embodiments, the method further includes picking up the napkin from a stack of napkins.

In some embodiments, picking up the napkin from the stack of napkins includes picking up the napkin using a fan.

In some embodiments, the method further includes picking up the at least one utensil from at least one magazine storing a plurality of utensils.

In some embodiments, picking up the at least one utensil includes picking up the at least one utensil using a utensil picker.

In some embodiments, placing the at least one utensil on the napkin includes dropping the at least one utensil on a chute disposed above the wrapping assembly.

In some embodiments, the first roller rotates about an axis of rotation that is fixed relative to the frame.

According to another aspect of the present technology, there is provided an apparatus for wrapping a napkin around at least one utensil. The apparatus includes a frame, a first roller, a second roller, a third roller, an actuator, a motor and an endless belt. The first roller is rotationally connected to the frame. The second roller is rotationally connected to the frame, and is movable between a first position and a second position. In the first position, the second roller is generally vertically aligned with the first roller. The second roller is closer to the first roller in the second position than in the first position in a horizontal direction. The actuator is operatively connected to the second roller for moving the second roller between the first position and the second position. The third roller is rotationally connected to the frame and is disposed vertically lower than the first and second rollers. The motor is operatively connected to one of the first, second and third rollers for rotating the one of the first, second and third rollers. The endless belt is wrapped around the first, second and third rollers. In an initial configuration of the first, second and third rollers, the second roller is in the first position, the endless belt is in tension about the first, second, and third rollers, and a portion of the endless belt extending between the first and second rollers defines a flat surface for receiving a napkin and the at least one utensil thereon. In a wrapping configuration of the first, second and third rollers, the second roller is in the second position, and the portion of the endless belt extending between the first and second rollers extends generally downward from the first roller to a low point and extends generally upward from the low point to the second roller for receiving the napkin and the at least one utensil at the low point such that rotation of the one of the first, second and third rollers by the motor causes the endless belt to turn around the first, second and third rollers thereby wrapping the napkin around the at least one utensil.

In some embodiments, the motor is operatively connected to the third roller for rotating the third roller.

In some embodiments, the second roller is movable between the first and second positions along a rectilinear path.

In some embodiments, the apparatus further includes a controller in communication with the motor and the actuator for controlling the motor and the actuator.

In some embodiments, the controller is programmed for consecutively controlling the actuator for placing the first, second and third rollers in the initial configuration, controlling the actuator for placing the first, second and third rollers in the wrapping configuration, controlling the motor to rotate the one of the first, second and third rollers for turning the endless belt around the first, second and third rollers, controlling the motor to stop rotating the first roller, and controlling the actuator for placing the first, second and third rollers in the initial configuration.

In some embodiments, the actuator is a first actuator. The third roller is movable between a third position, a fourth position and a fifth position where the third roller is closer to the first roller in the fourth position than in the third position in a vertical direction, and the fifth position of the third roller is intermediate the third and fourth positions of the third roller. The apparatus further includes a second actuator operatively connected to the third roller for moving the third roller between the third position, the fourth position and the fifth position. In the initial configuration of the first, second and third rollers, the third roller is in the third position. In a folding configuration of the first, second and third rollers, the second roller is in the first position, the third roller is in the fourth position, and the portion of the endless belt extending between the first and second rollers defines a V-shape for receiving the napkin and the at least one utensil at a bottom of the V-shape. In a wrapping configuration of the first, second and third rollers, the third roller is in the fifth position.

In some embodiments, the apparatus further includes a controller in communication with the motor, the first actuator and the second actuator for controlling the motor, the first actuator and the second actuator.

In some embodiments, the controller is programmed for consecutively controlling the first and second actuators for placing the first, second and third rollers in the initial configuration, controlling the first and second actuators for placing the first, second and third rollers in the folding configuration, controlling the first and second actuators for placing the first, second and third rollers in the wrapping configuration, controlling the motor to rotate the first roller for turning the endless belt around the first, second and third rollers, controlling the motor to stop rotating the first roller; and controlling the first and second actuators for placing the first, second and third rollers in the initial configuration.

In some embodiments, the second roller is pivotable between the first and second positions; and the third roller is pivotable between the third, fourth and fifth positions.

In some embodiments, the apparatus further includes at least one first pivotable arm operatively connected to the first actuator, the second roller being connected to the at least one first pivotable arm, and at least one second pivotable arm operatively connected to the second actuator, the third roller being connected to the at least one second arm.

In some embodiments, the motor is a first motor, and the actuator is a second motor.

In some embodiments, the apparatus further includes a napkin delivery assembly for delivering the napkin to the endless belt.

In some embodiments, the napkin delivery assembly includes a fan for picking up the napkin from a stack of napkins and is movable between the stack of napkins and the endless belt.

In some embodiments, the apparatus further includes a utensil delivery assembly for delivering the at least one utensil to the endless belt.

In some embodiments, the utensil delivery assembly includes at least one magazine for storing a plurality of utensils, and a utensil picker for picking up at least one utensil from the at least one magazine and delivering the at least one utensil to the endless belt.

In some embodiments, the first roller rotates about an axis of rotation that is fixed relative to the frame.

According to another aspect of the present technology, there is provided a utensil picker for picking up at least one utensil from at least one utensil magazine storing a plurality of utensils. The utensil picker includes at least one movable arm, at least one base connected to the at least one movable arm, and at least two fingers connected to each base of the at least one base. Each finger of the at least two fingers has a fingertip operatively connected to the base and an attachment. The fingertip is configured to move vertically with respect to the base, and the attachment is provided at an end of the fingertip for attaching one utensil of the at least one utensil to the finger.

In some embodiments, the attachment is a permanent magnet.

In some embodiments, the utensil picker further includes at least one track, the at least one movable arm being movable along the at least one track.

In some embodiments, the at least two fingers are connected under the base.

In some embodiments, each base includes an upper portion connected to the at least one movable arm, a lower portion connected to the upper portion, and a hinge connecting the upper portion to the lower portion.

In some embodiments, each finger of the at least two fingers further includes a spring connected to the base. The spring biases the fingertip away from the base.

In some embodiments, each finger of the at least two fingers further includes a housing connected to the base; and for each finger, the spring is housed in the housing.

In some embodiments, for each finger, the fingertip is slidable in the housing.

In some embodiments, the at least two fingers are five fingers arranged in a line.

According to another aspect of the present technology, there is provided an apparatus for wrapping a napkin around at least one utensil. The apparatus includes at least one magazine for storing the at least one utensil, a wrapping assembly for wrapping the napkin around the at least one utensil, and the utensil picker according to at least one of the above aspects or according to at least one of the above aspects and one or more of the above embodiments for picking up the at least one utensil from the at least one magazine and for bringing the at least one utensil from the at least one magazine to the wrapping assembly.

In some embodiments, each magazine of the at least one magazine has a corresponding at least two fingers of the at least two fingers, and for each magazine the corresponding at least two fingers are configured to pick up at least one utensil at a time from the magazine.

In some embodiments, for each magazine the corresponding at least two fingers are configured to pick up a single utensil at a time from the magazine.

In some embodiments, the apparatus further includes a comb having upwardly extending teeth, the comb being disposed above the wrapping assembly, and the at least one movable arm is configured to move the at least two fingers through spaces defined between teeth of the comb, thereby causing the comb to detach the at least one utensil picked up by the utensil picker from the at least two fingers and, as a result, cause the at least one utensil to fall toward the wrapping assembly.

In some embodiments, the apparatus further includes a chute disposed at least in part vertically between the comb and the wrapping apparatus such that the at least one utensil detached from the utensil picker by the comb falls on the chute and then falls from the chute on the wrapping assembly.

In some embodiments, the apparatus further includes a chute disposed above the wrapping assembly, and the at least one movable arm is configured to move above the chute such that the at least one utensil picked up by the utensil picker can be dropped from the utensil picker onto the chute and then fall from the chute on the wrapping assembly.

In some embodiments, the apparatus further includes a napkin delivery assembly for delivering the napkin to the wrapping assembly.

In some embodiments, the napkin delivery assembly includes a fan for picking up the napkin from a stack of napkins and is movable between the stack of napkins and the wrapping assembly.

According to another aspect of the present technology, there is provided a magazine for storing a plurality of utensils. The magazine has a receptacle and at least one set of dividers. The receptacle has a first side defining a first opening, a second side opposite the first side, a third side extending between the first and second sides, the third side defining a second opening, a fourth extending between the first and second sides, the fourth side being opposite the third side, a fifth side; and a sixth side opposite the fifth side. The first, second, third and fourth sides extend between the fifth and sixth sides. The at least one set of dividers is disposed in the receptacle. The dividers are spaced apart from each other between the third side to the fourth side. The at least one set of dividers is movable between a first position and a second position. In the first position, the dividers extend at least partially across the receptacle toward one of the fifth side and the sixth side such that utensils can be inserted via the first opening between the dividers and the dividers keep the utensils apart from each other. In the second position, the dividers extend toward one of the first side and the second side such that moving the at least one set of dividers from the first position to the second position with the receptacle lying on its fourth side causes utensils inserted between the dividers to fall in a stack on the fourth side, and the utensils can be removed from the stack via the second opening.

In some embodiments, the magazine further includes a lid for selectively closing the first opening.

In some embodiments, the lid is hinged to the receptacle.

In some embodiments, the magazine further includes at least one shaft extending in the receptacle. The at least one set of dividers is connected to the at least one shaft, and the at least one shaft is rotatable to move the at least one set of dividers between the first position and the second position.

In some embodiments, the dividers are generally perpendicular to the at least one shaft.

In some embodiments, the at least one shaft passes through the second opening and protrudes from the receptacle.

In some embodiments, the at least one set of dividers includes a first set of dividers and a second set of dividers, and the first set of dividers is disposed between the first side and the second set of dividers.

In some embodiments, in the second position, the dividers of the first set of dividers extend toward the second side, and in the second position, the dividers of the second set of dividers extend toward the first side.

In some embodiments, the at least one set of dividers includes a first set of dividers and a second set of dividers. The first set of dividers is disposed next to the fifth side, the second set of dividers is disposed next to the sixth side and the first and second sets of dividers are at a same distance from the first side. In the first position, the dividers of the first set of dividers extend toward the sixth side; and in the first position, the dividers of the second set of dividers extend toward the fifth side.

In some embodiments, with the first set of dividers in the first position and with the second set of dividers in the first position, each divider of the first set of dividers is coaxial with a corresponding divider of the second set of dividers.

In some embodiments, the at least one set of dividers further includes a third set of dividers and a fourth set of dividers. The first and second sets of dividers are disposed between the first side and the third and fourth set of dividers. The third set of dividers is disposed next to the fifth side, the fourth set of dividers is disposed next to the sixth side and the third and fourth sets of dividers are at a same distance from the first side. In the first position, the dividers of the third set of dividers extend toward the sixth side; and in the first position, the dividers of the fourth set of dividers extend toward the fifth side.

In some embodiments, in their second positions, the dividers of the first and second sets of dividers extend toward the second side; and in their second positions, the dividers of the third and fourth sets of dividers extend toward the first side.

In some embodiments, with the third set of dividers in the first position and with the fourth set of dividers in the first position, each divider of the third set of dividers is coaxial with a corresponding divider of the fourth set of dividers.

In some embodiments, the dividers are spacers.

According to another aspect of the present technology, there is provided an apparatus for wrapping a napkin around at least one utensil. The apparatus includes at least one magazine according to at least one of the above aspects or according to at least one of the above aspects and one or more of the above embodiments for storing the at least one utensil, a wrapping assembly for wrapping the napkin around the at least one utensil, and a utensil picker for picking up the at least one utensil from the at least one magazine via the second opening and for bringing the at least one utensil from the at least one magazine to the wrapping assembly.

In some embodiments, the second opening of the at least one magazine faces up.

In some embodiments, the at least one magazine is a plurality of magazines disposed next to each other.

In some embodiments, the apparatus further includes a napkin delivery assembly for delivering the napkin to the wrapping assembly.

In some embodiments, the napkin delivery assembly includes a fan for picking up the napkin from a stack of napkins and is movable between the stack of napkins and the wrapping assembly.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
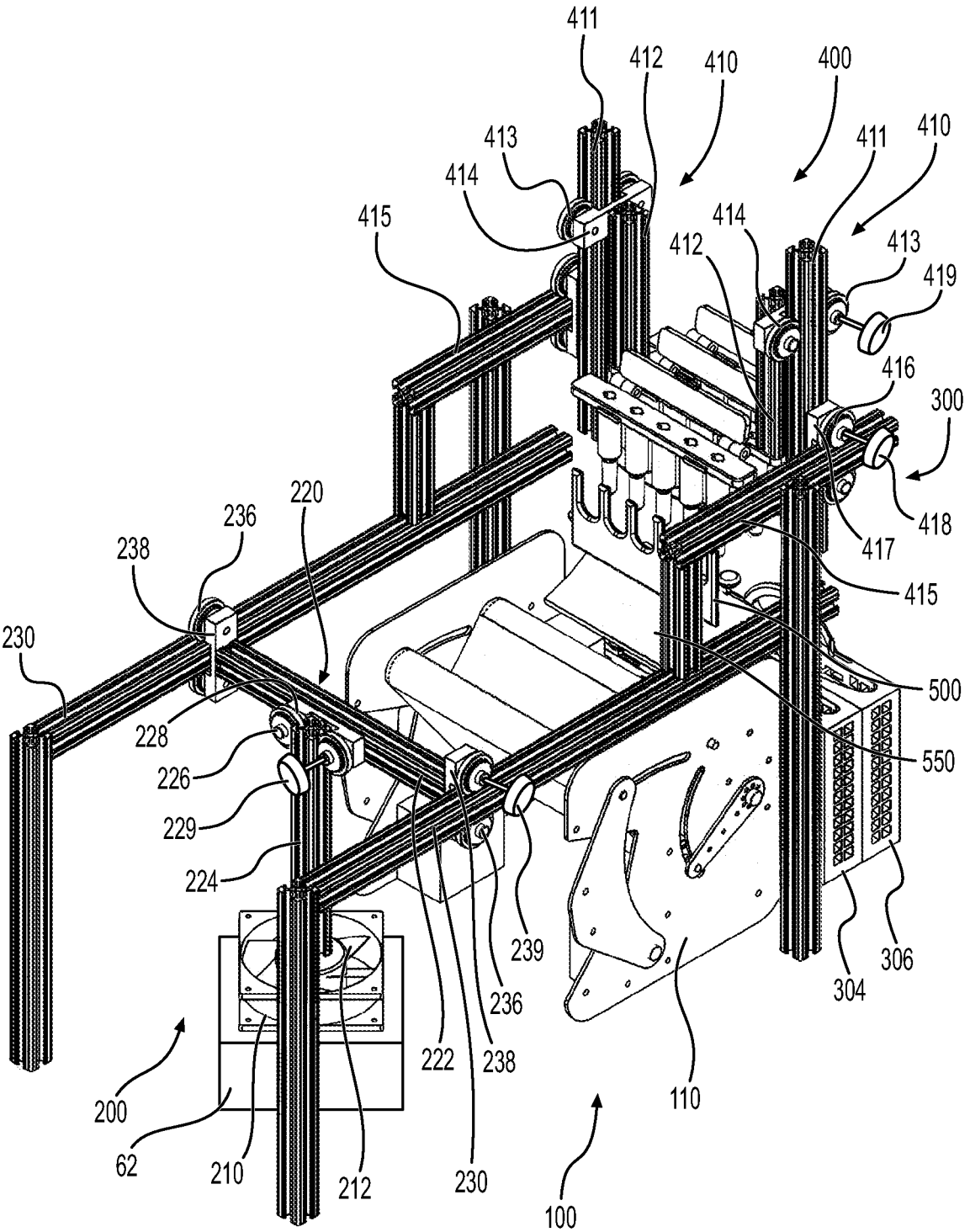
FIG. 1 is a perspective view taken from a front, top, right side of an apparatus for wrapping a napkin around utensils.

The present detailed description is intended to be a description of illustrative examples of the present technology.

The present technology relates to an apparatus 50 for wrapping a napkin 60 around utensils. In the present embodiment, the apparatus 50 includes a wrapping assembly 100, a napkin delivery assembly 200 and a utensil delivery assembly 300. The napkin delivery assembly 200 is configured to deliver a napkin 60 to the wrapping assembly 100. The utensil delivery assembly 300 is configured to deliver utensils to the wrapping assembly 100 on the napkin 60 delivered by the napkin delivery assembly 200. The wrapping assembly 100 is configured to wrap the napkin 60 around the utensils.

Figure 8:
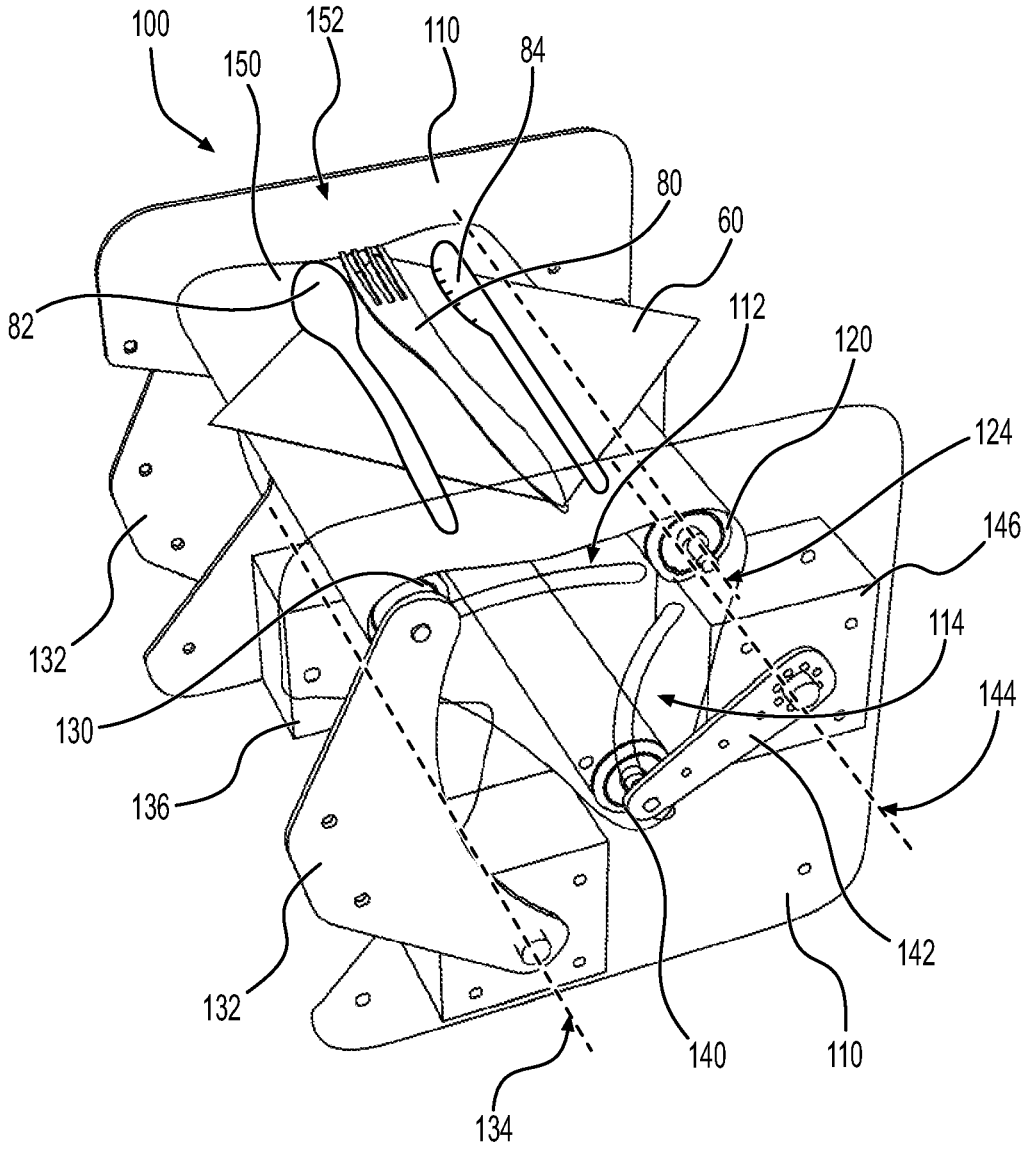
FIG. 8 is a perspective view taken from a front, top, right side of the wrapping assembly of FIG. 7 in an initial configuration, with a frame shown in transparency.

Referring to FIGS. 1 to 6, the apparatus 50 will be described. In the present embodiment, the wrapping assembly 100 has a frame 110. A driven roller 120, an upper idler roller 130 and a lower idler roller 140 (best seen in FIG. 8) are rotationally connected to the frame 110. An endless belt 150 is wrapped around the driven roller 120, the upper idler roller 130, and the lower idler roller 140. In the present embodiment, the napkin delivery assembly 200 includes a fan 210 that is movable. The utensil delivery assembly 300 includes three magazines 302, 304, 306 and a utensil picker 400.

Referring to FIGS. 7 to 11, the wrapping assembly 100 will be described in greater detail. As mentioned above, the wrapping assembly 100 has the driven roller 120, the upper idler roller 130 and the lower idler roller 140. A motor 122 (schematically shown in FIG. 12 and shown in FIGS. 22 to 26 with reference to a wrapping assembly 1100) is operatively connected to the driven roller 120. When the motor 122 is operated, the driven roller 120 rotates about a driven roller axis 124. In some embodiments, the motor 122 is a stepper motor 122, but other types of motors are contemplated.

The upper idler roller 130 is disposed inside the frame 110, and is connected to the frame 110 via a pair of pivotable arms 132 that is disposed outside the frame 110. The pair of pivotable arms 132 connects to the upper idler roller 130 through a pair of slots 112 that is defined in the frame 110. The pair of pivotable arms 132 is further pivotally connected to the frame 110, and pivots about a pivot axis 134. Thus, the pair of slots 112 is arcuate to accommodate for the pivotal movement of the upper idler roller 130 and the pair of pivotable arms 132. It is contemplated that in some embodiments, the pair of slots 112 could be linear. It is also contemplated that in some embodiments, only a single arm 132 could be provided. Two actuators 136 are connected to the pair of pivotable arms 132, such that when the actuators 136 are actuated, the pair of pivotable arms 132 pivots about the pivot axis 134, resulting in the movement of the upper idler roller 130. It is contemplated that there could be more or less than two actuators. In the present embodiment, the actuators 136 are stepper motors. It is also contemplated that in some embodiments, the actuators 136 could be other types of motor or other types of actuators, such as pneumatic or hydraulic cylinders for example.

The upper idler roller 130 is movable between an initial position and a wrapping position. It is contemplated that in some embodiments, the upper idler roller 130 could be moved to positions intermediate these two positions. In the initial position, the upper idler roller 130 is generally vertically aligned with the driven roller 120. In the wrapping position (shown in FIG. 10), the upper idler roller 130 is horizontally closer to the driven roller 120 than when the upper idler roller 130 is in the initial position. The upper idler roller 130 is pivotable between the initial position and the wrapping position about the pivot axis 134, in an arcuate path, but it is contemplated that in some embodiments, the upper idler roller 130 could move in a linear path. Thus, upon actuation of the actuator 136, the upper idler roller 130 pivots from the initial position to the wrapping position, or vice-versa.

The lower idler roller 140 is disposed inside the frame 110, and is connected to the frame 110 via a pair of pivotable arms 142 that is disposed outside the frame 110. The pair of pivotable arms 142 connects to lower idler roller 140 through a pair of slots 114 that are defined in the frame 110. The pair of pivotable arms 142 is further pivotally connected to the frame 110, and pivots about a pivot axis 144. Thus, the pair of slots 114 is arcuate to accommodate for the pivotal movement of the lower idler roller 140 and the pair of pivotable arms 142. It is contemplated that in some embodiments, the pair of slots 114 could be linear. It is also contemplated that in some embodiments, only a single arm 132 could be provided. The lower idler roller 140 is disposed vertically lower than the driven roller 120 and the upper idler roller 130. Two actuators 146 are connected to the pair of pivotable arms 142, such that when the actuators 146 are actuated, the pair of pivotable arms 142 pivots about the pivot axis 144, resulting in the movement of the lower idler roller 140. It is contemplated that there could be more or less than two actuators 146. In the present embodiment, the actuators 146 are stepper motors. It is also contemplated that in some embodiments, the actuators 146 could be other types of motor or other types of actuators, such as pneumatic or hydraulic cylinders for example.

The lower idler roller 140 is movable between an initial position, a folding position and a wrapping position. It is contemplated that in some embodiments, the lower idler roller 140 could be moved to positions intermediate these three positions. In the initial position (shown in FIG. 8), the lower idler roller 140 is vertically furthest to the driven roller 120. In the folding position (shown in FIG. 9), the lower idler roller 140 is closer to the driven roller 120 than in the initial position in a vertical direction. In the wrapping position (shown in FIG. 10), the lower idler roller 140 is intermediate to the initial position and the folding position. In any one of the initial, folding and wrapping position, the lower idler roller 140 remains vertically lower than the driven roller 120 and the upper idler roller 130. In the present embodiment, the lower idler roller 140 is pivotable between the initial position, the folding position and the wrapping position about the pivot axis 144, in an arcuate path, but it is contemplated that in some embodiments, the lower idler roller 140 could be movable in a linear path. Thus, upon actuation of the actuator 146, the lower idler roller 140 pivots from the initial position to the wrapping position and/or to the folding position.

As mentioned above, the endless belt 150 is wrapped around the driven roller 120, the upper idler roller 130 and the lower idler roller 140. In the present embodiment, the endless belt 150 is made from a textile material, though it is contemplated that other suitable materials could be used. As will be described in greater detail below, when the motor 122 is actuated, the endless belt 150 turns around the driven roller 120, the upper idler roller 130 and the lower idler roller 140, and when the motor 122 is stopped, the endless belt 150 stops turning.

Referring to FIGS. 8 to 11, the various configurations of the wrapping assembly 100 will now be described in greater detail. In the present embodiment, the wrapping assembly 100 has an initial configuration, a folding configuration and a wrapping configuration. It is contemplated that in other embodiments, there could be more than three configurations.

In the initial configuration (seen in FIG. 8), the upper idler roller 130 and the lower idler roller 140 are in their initial positions. In this configuration, the endless belt 150 is in tension about the driven roller 120, the upper idler roller 130 and the lower idler roller 140. In the initial configuration, a portion 152 of the endless belt 150 extending between the driven roller 120 and the upper idler roller 130 defines a flat surface. As will be described in greater detail below, the flat surface is adapted to receive the napkin 60 and utensils thereon.

In the folding configuration (seen in FIG. 9), the upper idler roller 130 is in the initial position, while the lower idler roller 140 is in the folding position. The positioning of the upper idler roller 130 and the lower idler roller 140 result in the endless belt 150 not being in tension between the driven roller 120 and the upper idler roller 130. The portion 152 of the endless belt extending between the driven roller 120 and the upper idler roller 130 droops to define a V-shape. As will be described in greater detail below, the napkin 60 and the utensils are received at a bottom of the V-shape.

In the wrapping configuration (seen in FIG. 10), the upper idler roller 130 and the lower idler roller 140 are in their wrapping positions. The position of the upper idler roller 130 and the lower idler roller 140 result in the portion 152 of the endless belt 150 extending generally downward from the driven roller 120 to a low point, and generally upward from the low point to the upper idler roller 130. Thus, the endless belt 150 is taut compared to when the endless belt 150 was in the folding configuration. As will be described in greater detail below, the portion 152 receives the napkin and the utensil at the low point, such that when the motor 122 is operated, and the driven roller 120 rotates, the rotation causes the endless belt 150 to turn around the driven roller 120, the upper idler roller 130 and the lower roller 140, which thereby results in the napkin wrapping around the utensils, yielding the wrapped utensil, shown in FIG. 11.

Figure 12:
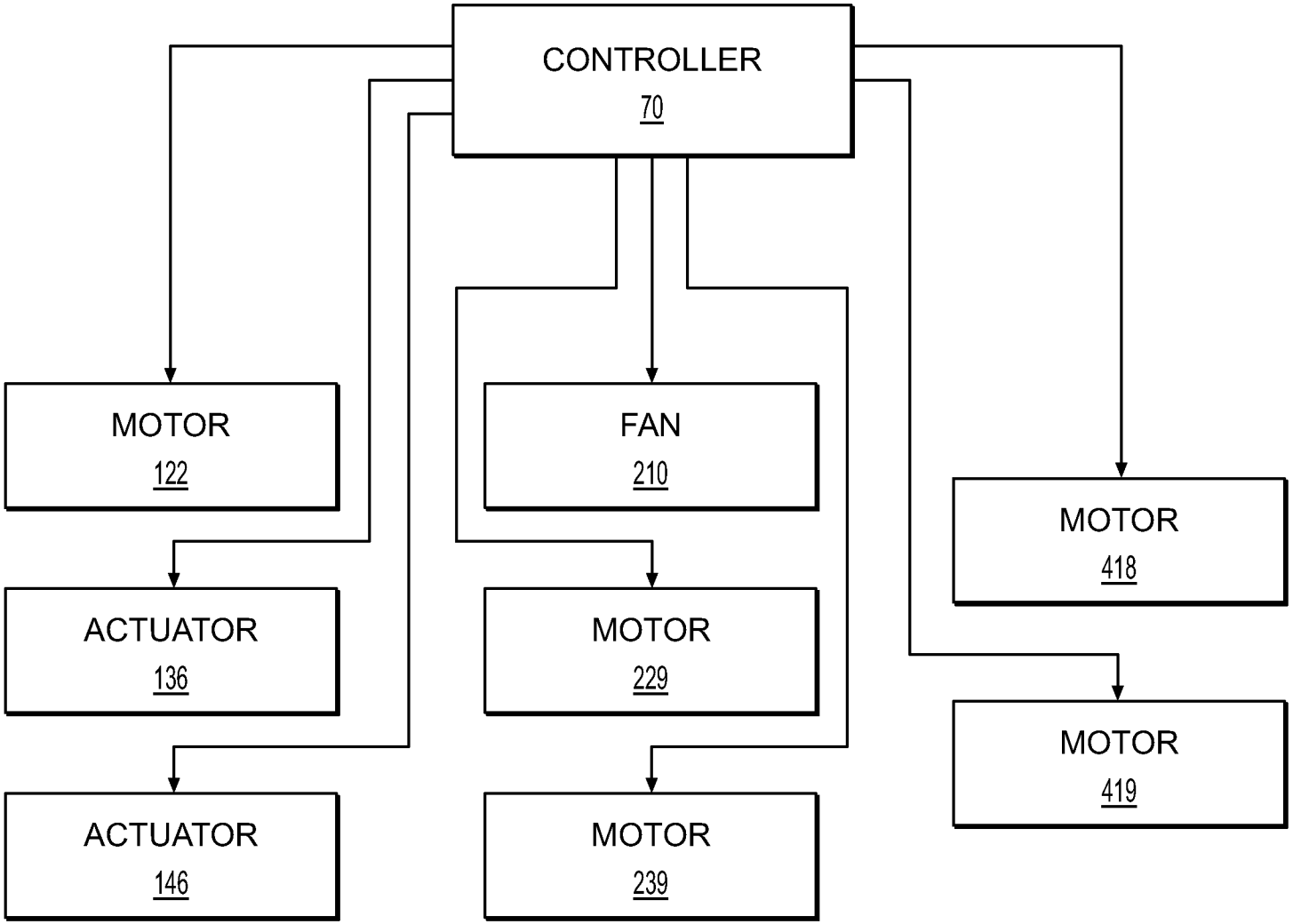
FIG. 12 is a schematic illustration of connections between a controller, motor and actuators of the wrapping assembly of the apparatus of FIG. 1.
Figure 13:
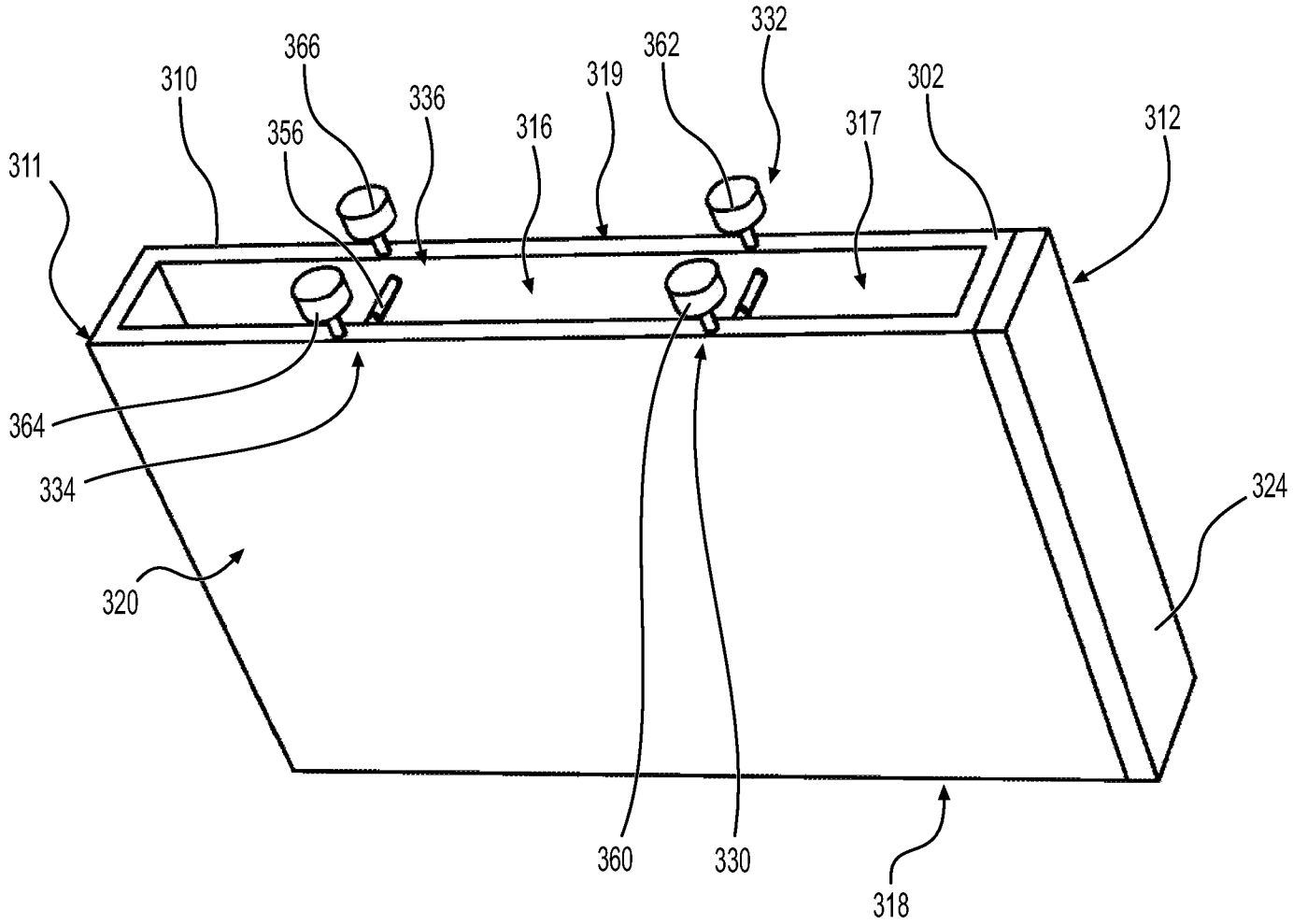
FIG. 13 is a perspective view taken from a rear, top, left side of one of the magazines of the apparatus of FIG. 1.

Referring to FIG. 12, in the present embodiment, the apparatus 50 also includes a controller 70. The controller 70 is in communication with the fan 210, a motor 229, a motor 239, a motor 418 and a motor 419, the motor 122, the actuators 136 and the actuators 146 such that the controller 70 controls the fan 210, the motor 229, the motor 239, the motor 418, the motor 419, the motor 122, the actuators 136 and the actuators 146. It is contemplated that in some embodiments, the controller 70 could be omitted.

In the present embodiment, the controller 70 is programmed to control the actuators 136 and the actuators 146 to consecutively position the wrapping assembly 100 in the initial configuration, in the folding configuration and then in the wrapping configuration. The controller 70 then controls the motor 122 to rotate the driven roller 120, which turns the endless belt 150 around the driven roller 120, the upper idler roller 130 and the lower idler roller 140. The controller 70 then controls the motor 122 to stop the rotation of the driven roller 120. The controller 70 then finally controls the actuators 136 and the actuators 146 to position the wrapping assembly 100 back in the initial configuration. The controller 70 thus automates the wrapping of the napkin 60 around the utensils. As will be described in greater detail below, the controller 70 also automates the delivery of a napkin to the endless belt 150, and the delivery of utensils to the endless belt 150.

Turning back to FIGS. 1 to 6, the napkin delivery assembly 200 adapted for delivering a napkin to the endless belt 150 will now be described in more detail. In the present embodiment, the napkin delivery assembly 200 includes a fan 210. The fan 210 has fan blades 212 and a grill (not shown). In the present embodiment, when the fan 210 is turned on, the fan 210 suctions air through a bottom thereof. The grill prevents the napkin from being suctioned into the fan blades 212. In the present embodiment, the fan 210 is vertically and horizontally movable, as the fan 210 is operatively connected to arms 220, 230. In the present embodiment, the arms 220, 230 are T-tracks. The arm 220 has an upper track 222 and a lower track 224. The lower track 224 is connected to the upper track 222 via a pair of T-slot wheels 226 and a bracket 228. More precisely, the pair of T-slot wheels 226 is connected to the bracket 228, and to the lower track 224. The bracket 228 is fixedly connected to the upper track 222. Thus, when the pair of T-slot wheels 226 is actuated by the motor 229, the pair of T-slot wheels 226 roll on the lower track 224, such that the lower track 224 moves in the vertical direction. In the present embodiment, the motor 229 is a stepper motor. The upper track 222 is connected to the two arms 230 by two pairs of T-slot wheels 236 and two brackets 238. More precisely, each of the two pairs of T-slot wheels 236 is connected to one of the brackets 238, and to the arm 230. The brackets 238 is fixedly connected to the upper track 222. Thus, when the pair of T-slot wheels 236 that is connected to the motor 239, is actuated by the motor 239, the two pairs of T-slot wheels 236 roll along the arm 230, such that the upper track 222 moves along the arms 230. In the present embodiment, the motor 239 is a stepper motor. It is contemplated that in other embodiments, the fan 210 could be movable by other mechanisms. For instance, it is contemplated that the fan 210 could move from one position to another by a mechanical arm. In the present embodiment, the fan 210 is movable from a stack of napkins 62 to the endless belt 150. To deliver a napkin to the endless belt 150, the fan 210 is moved above the stack of napkins 62. The fan 210 is then moved down until a top of the stack of napkins 62 is reached. The fan 210 is then turned on, and air begins to be suctioned, which results in the fan 210 picking up a napkin 60. The fan 210, and thus the napkin 60, is then moved to a position above the endless belt 150. When in position, the fan 210 is turned off, which releases the napkin 60 onto the endless belt 150. These steps are repeated for other napkins. In the present embodiment, the controller 70 turns the fan 210 on and off, and controls the movement of the fan 210 via the arms 220, 230.

The utensil delivery assembly 300 adapted for delivering utensils to the endless belt 150 will now be described in more detail. In the present embodiment, the utensil delivery assembly 300 includes the three magazines 302, 304, 306 and the utensil picker 400. The utensil picker 400 is adapted to pick up utensils from each of the three magazines 302, 304, 306 and deliver the utensils to the endless belt 150 on top of a napkin 60. It the present embodiment, the magazine 302 holds forks, the magazine 304 holds spoons, and the magazine 306 holds knives.

Referring to FIGS. 13 to 16, the magazines 302, 304, 306 will be described in greater detail. The magazines 302, 304, 306 are disposed next to each other, and are adapted for storing utensils therein. The magazines 302, 304, 306 also defines apertures (shown in FIGS. 1, 2, 3, 5 and 6) to permit water and/or soap to flow through the magazines 302, 304, 306. It is contemplated that in other embodiments, there could be more or less than three magazines. As the magazines 302, 304, 306 are identical, only the magazine 302 will be described in detail herein.

The magazine 302 has a receptacle 310. In the present embodiment, the receptacle 310 has a front side 311, a rear side 312, a top side 316, a bottom side 318, a left side 319 and right side 320. It is contemplated that in other embodiments, the receptacle 310 could have another shape. The rear side 312 is opposite to the front side 311. The top side 316 extends between the front side 311 and the rear side 312. The bottom side 318 is opposite to the top side 316, and also extends between the front side 311 and the rear side 312. The right side 320 is opposite to the left side 319. The front, rear, top and bottom sides 311, 312, 316, 318 extend between the left and right sides 319, 320. In the present embodiment, the rear side 312 defines an opening 313 (FIG. 14), and the top side 316 defines an opening 317, which faces up when the magazine 302 rests on its bottom side 318.

The magazine 302 has a lid 324 that is hinged to the lower, rear corner of the receptacle 310. It is contemplated that in other embodiments, the lid 324 could be hinged elsewhere, or could be removable. The lid 324 selectively closes the opening 313. It is contemplated that the lid 324 could be omitted. It is also contemplated that the lid 324 could be another type of lid, such as a slidable lid.

The magazine 302 has four sets of dividers 330, 332, 334, 336 disposed in the receptacle 310. It is contemplated that in other embodiments, there could be more or less than four sets of dividers.

In the present embodiment, the set of dividers 330 is disposed next to the right side 320, and the set of dividers 332 is disposed next to the left side 319. The sets of dividers 330, 332 are disposed at a same distance from the front side 311. Likewise, the set of dividers 334 is disposed next to the right side 320, and the set of dividers 336 is disposed next to the left side 319. The sets of dividers 334, 336 are disposed at a same distance from the front side 311. In the present embodiment, the set of dividers 330, 332 are disposed between the front side 311 and the set of dividers 334, 336.

It is contemplated that in some embodiments there could only be two sets of dividers, where the two sets of dividers are disposed next to the left side 319, and one of the two sets of dividers is closer to the rear side 312, such that one of the sets of dividers is between the rear side 312 and the other set of dividers.

In the present embodiment, the set of dividers 330 has dividers 350 that are connected perpendicularly to a shaft 340 and has a knob 360 that is on a top end thereof, the set of dividers 332 has dividers 352 that are connected perpendicularly to a shaft 342 and has a knob 362 that is on a top end thereof, the set of dividers 334 has dividers 354 that are connected perpendicularly to a shaft 344 and has a knob 364 that is on a top end thereof and the set of dividers 336 has dividers 356 that connected perpendicularly to a shaft 346 and has a knob 366 that is on a top end thereof.

As the sets of dividers 330, 332, 334, 336 are identical, only the set of dividers 330 will be described in detail herein. The set of dividers 330 has eleven dividers 350. It is contemplated that there could be more or less than eleven dividers 350. In the present embodiment, the dividers 350 are spacers. In the present embodiment, the eleven dividers 350 are generally perpendicular to the shaft 340, though it is contemplated that in some embodiments, the dividers 350 could be slanted with respect to the shaft 340. The dividers 350 are spaced apart from each other between the top and bottom sides 316, 318. In other words, the dividers 350 are vertically spaced. The shaft 340 extends in the receptacle 310, and protrudes therefrom such that the shaft 340 passes through the opening 317. The knob 360 is on the top end of the shaft 340 that protrudes from the receptacle 310. It is contemplated that in some embodiments, the shaft 340 could be omitted, while the set of dividers 330 remains. The set of dividers 330 is movable between a holding position and a retracted position. The set of dividers 330 can be moved between the holding position and the retracted position by manually rotating the knob 360, which rotates the shaft 340. It is contemplated that in some embodiments, the set of dividers 330 could be movable between the holding position and the retracted position without the help of the shaft 340 and/or the knob 360. In some embodiments, the knob 360 and/or the shaft 340 could be rotated by an actuator.

It is contemplated that in some embodiments, turning the knob 360 could simultaneously rotate the shafts 340, 342, such that the sets of dividers 330, 332 are both moved from the holding position to the retracted position upon rotation of the knob 360. It is also contemplated that in some embodiments, turning the knob 360 could simultaneously rotate the shafts 340, 342, 344, 346, such that the sets of dividers 330, 332, 334, 336 all move from the holding position to the retracted position upon rotation of the knob 360. It is contemplated that any of the knobs 360, 362, 364, 366 could be rotated to reach this effect. In such embodiments, the magazine 302 has gears, belts and/or pulleys connecting the shafts 340, 342, 344, 346.

Figure 14:
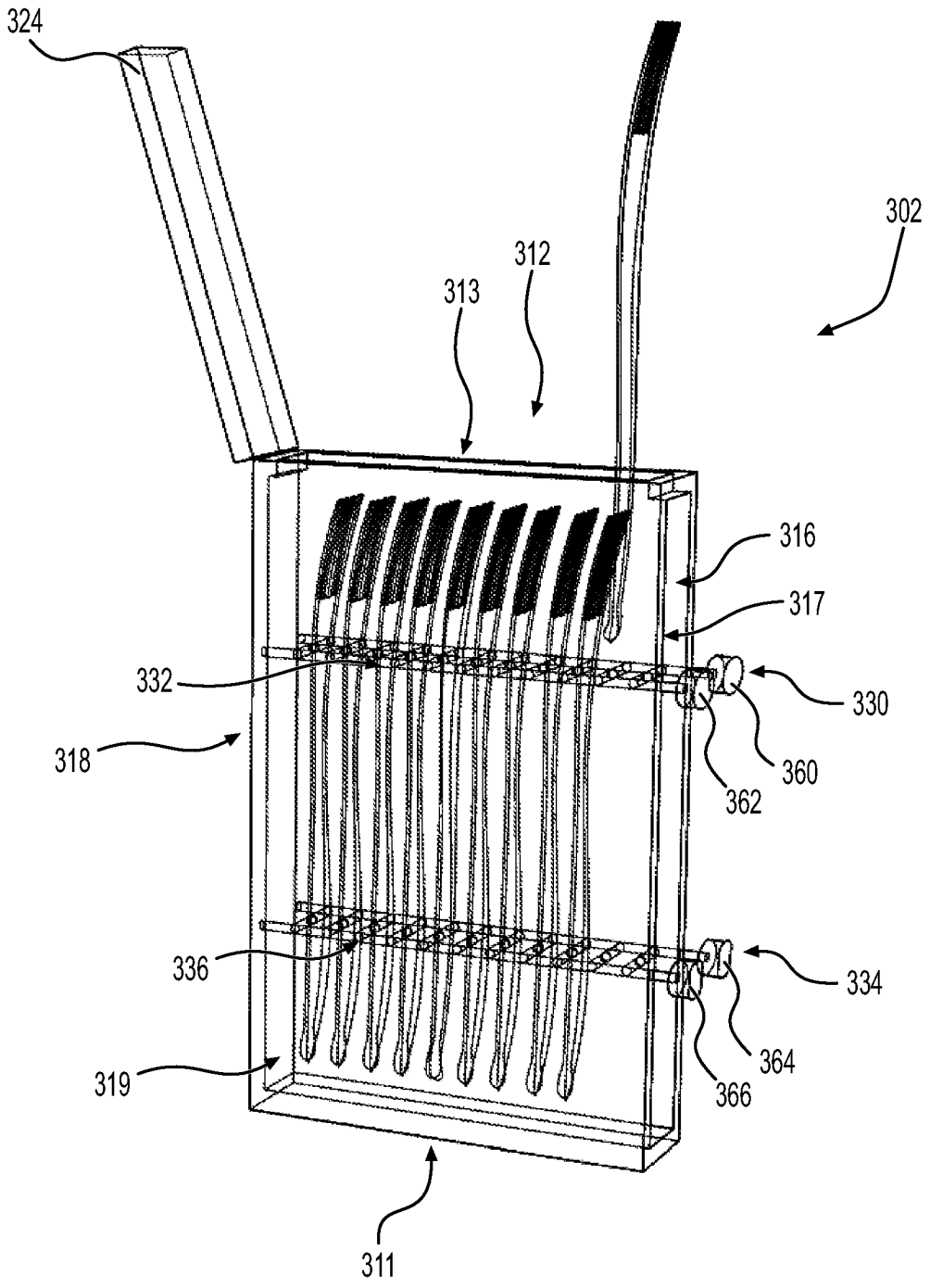
FIG. 14 is a perspective view of the magazine of FIG. 13 and utensils, with the magazine standing upright on its front side, and with portions of the magazine shown in transparency.
Figure 15:
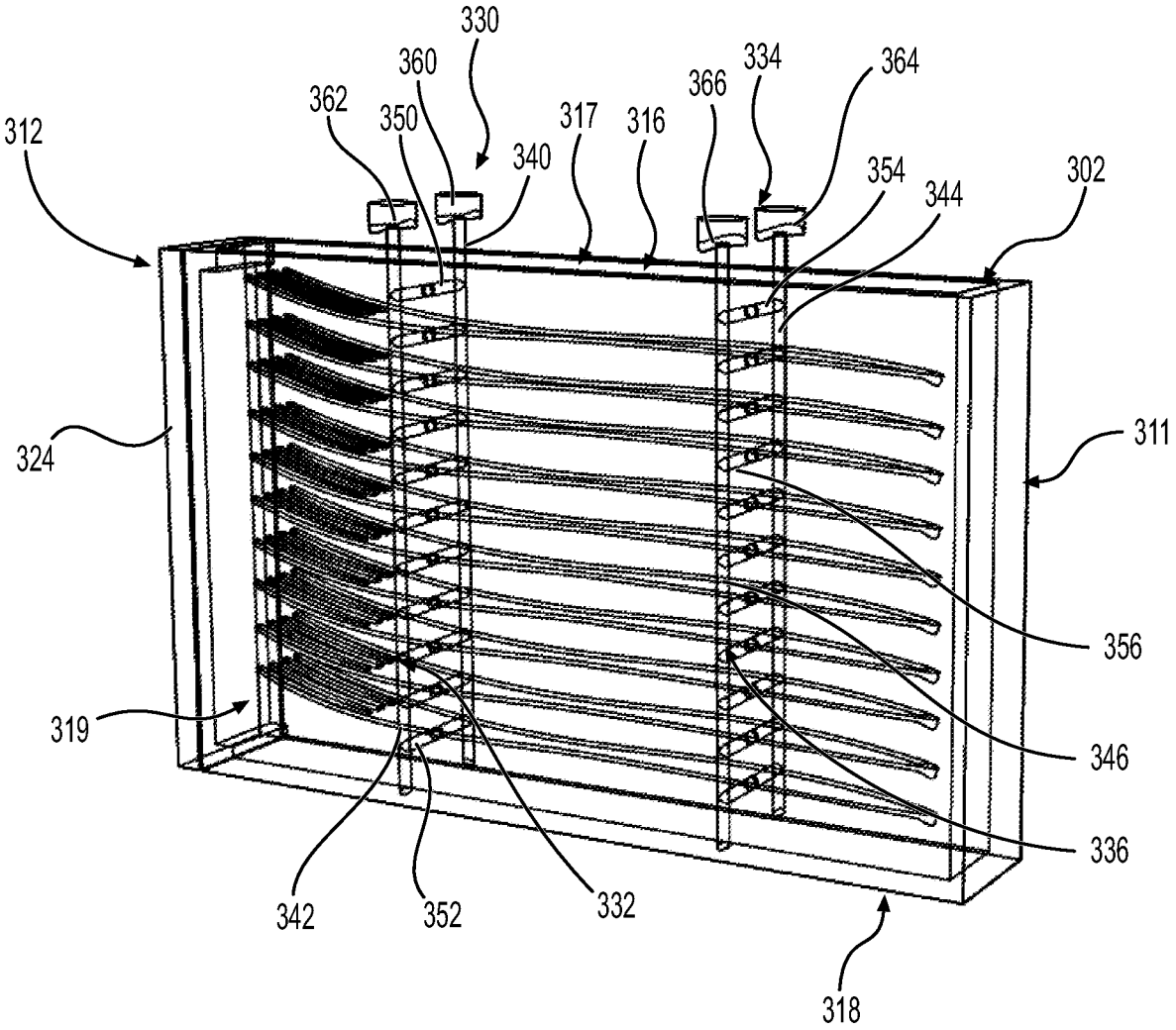
FIG. 15 is a perspective view taken from a front, top, right side of the magazine of FIG. 13 and utensils, with sets of dividers of the magazine being in a holding position and with portions of the magazine shown in transparency.

Referring to FIGS. 14 and 15, the sets of dividers 330, 332, 334, 336 when they are in the holding position will now be described.

In the holding position, the dividers 350 of the set of dividers 330 extend about halfway across the receptacle 310 toward the left side 319, whereas the dividers 352 of the set of dividers 332 extend about halfway across the receptacle 310 toward the right side 320. In the holding position, each divider 350 is coaxial with a corresponding divider 352. Likewise, the dividers 354 of the set of dividers 334 extend about halfway across the receptacle 310 toward the left side 319, whereas the dividers 356 of the set of dividers 336 extend about halfway across the receptacle 310 toward the right side 320. In this position, each divider 354 is coaxial with a corresponding divider 356. It is contemplated that in some embodiments, the dividers 350, 352, 354, 356 could extend more or less than about half-way across the receptacle 310.

It is contemplated that in some embodiments, there could be only two sets of dividers, where one of the two sets of dividers is disposed next to the left side 319 and the other set of dividers is disposed next to the right side 320. In such embodiments, the two sets of dividers are at a same distance from the front side 311, and in the holding position, the dividers of one of the sets of dividers extend to the right side 320, and the dividers of the other set of dividers extend to the left side 319.

When the sets of dividers 330, 332, 334, 336 are in the holding position, as shown in FIG. 15, utensils can be inserted in the magazine 302, from the opening 313, between the dividers 350. To do so, the magazine 302 is placed upright on the front side 311, such that the opening 313 and the lid 324 are oriented in the upward direction. The lid 324 is then opened. A utensil is then put inside each space defined by the sets of dividers 330, 332, 334, 336, until the magazine 302 is fully loaded. The lid 324 is then closed. The dividers 350, 352, 354, 356 keep the utensils apart from each other, such that placing the magazine 302 in a dishwasher would permit adequate cleaning of the utensils.

Figure 16:
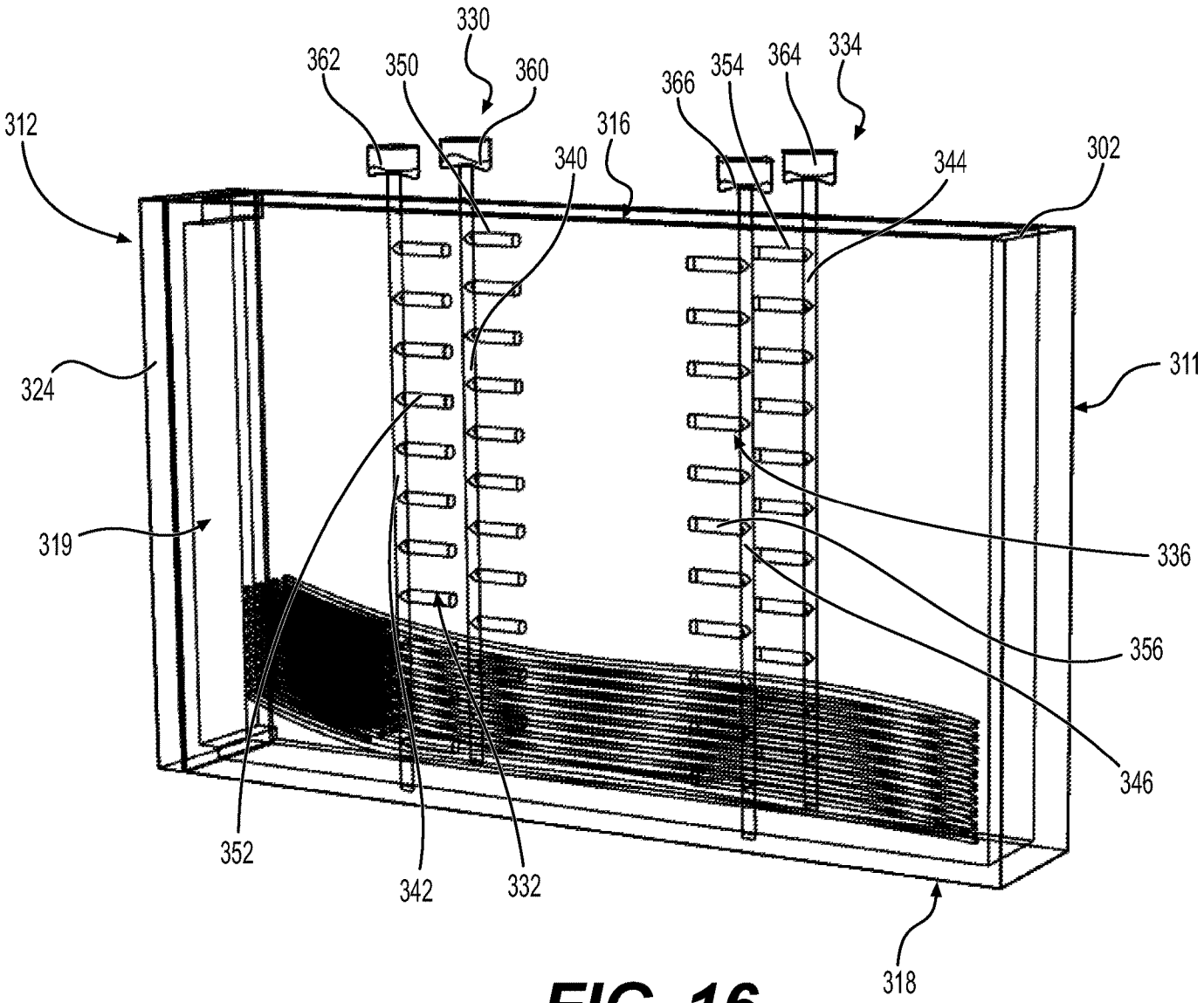
FIG. 16 is a perspective view taken from a front, top, right side of the magazine of FIG. 13 and utensils, with the sets of dividers of the magazine being in a retracted position and with portions of the magazine shown in transparency.
Figure 17:
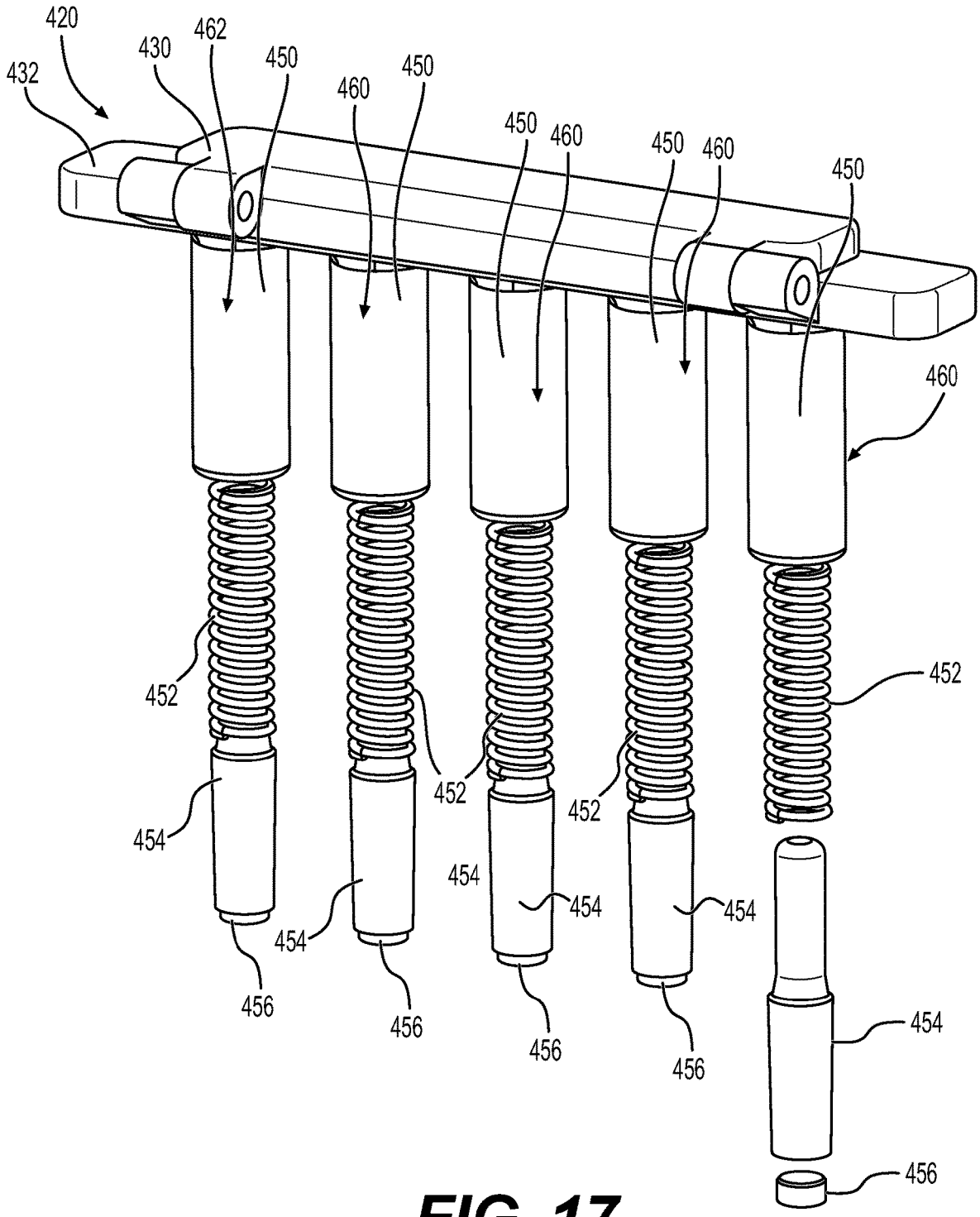
FIG. 17 is an exploded, perspective view, taken from a rear, top, right side of a portion of a base and fingers of the utensil picker of the apparatus of FIG. 1.
Figure 18:
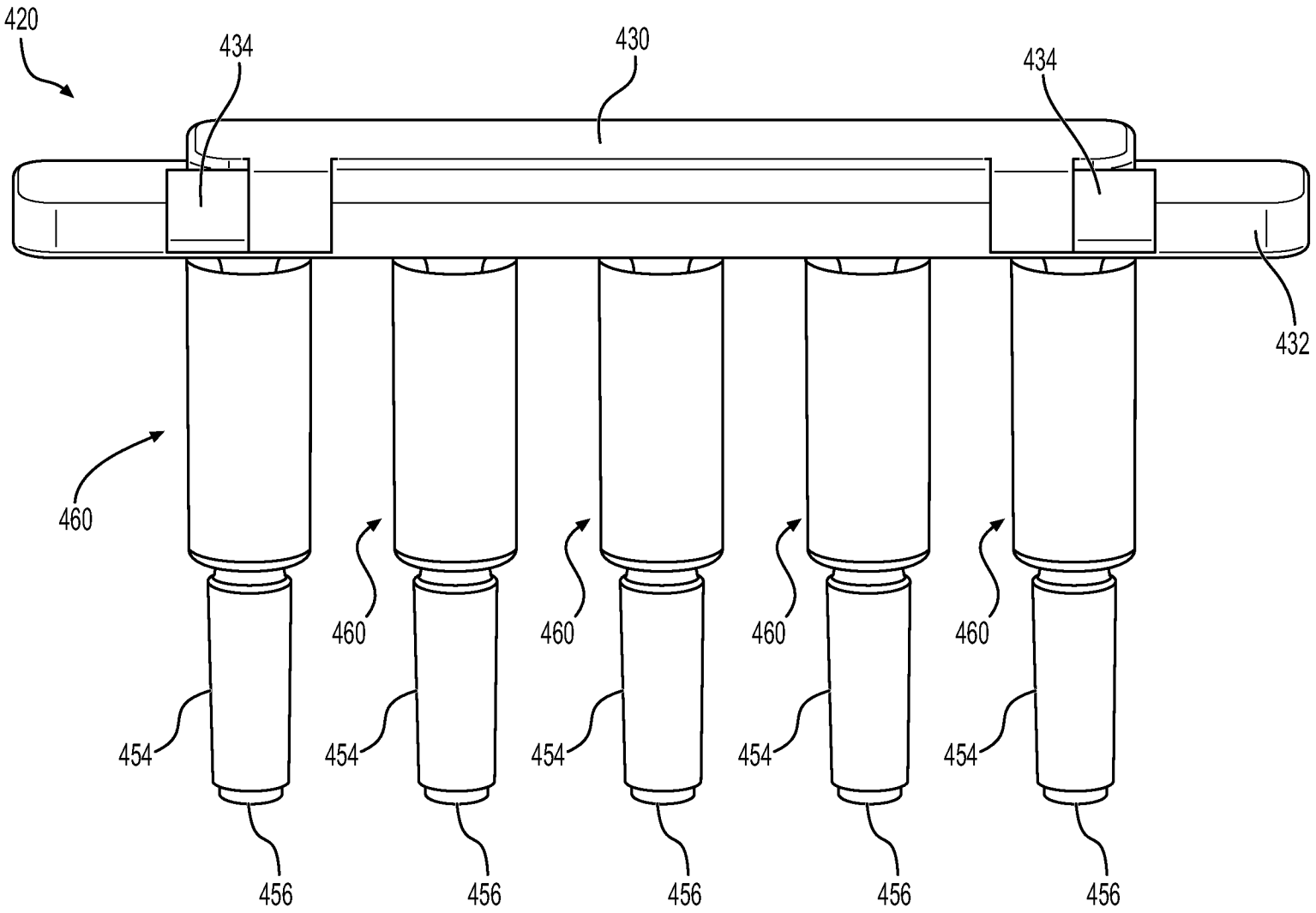
FIG. 18 is a left side view of the base and fingers of the utensil picker of the apparatus of FIG. 1.
Figure 19:
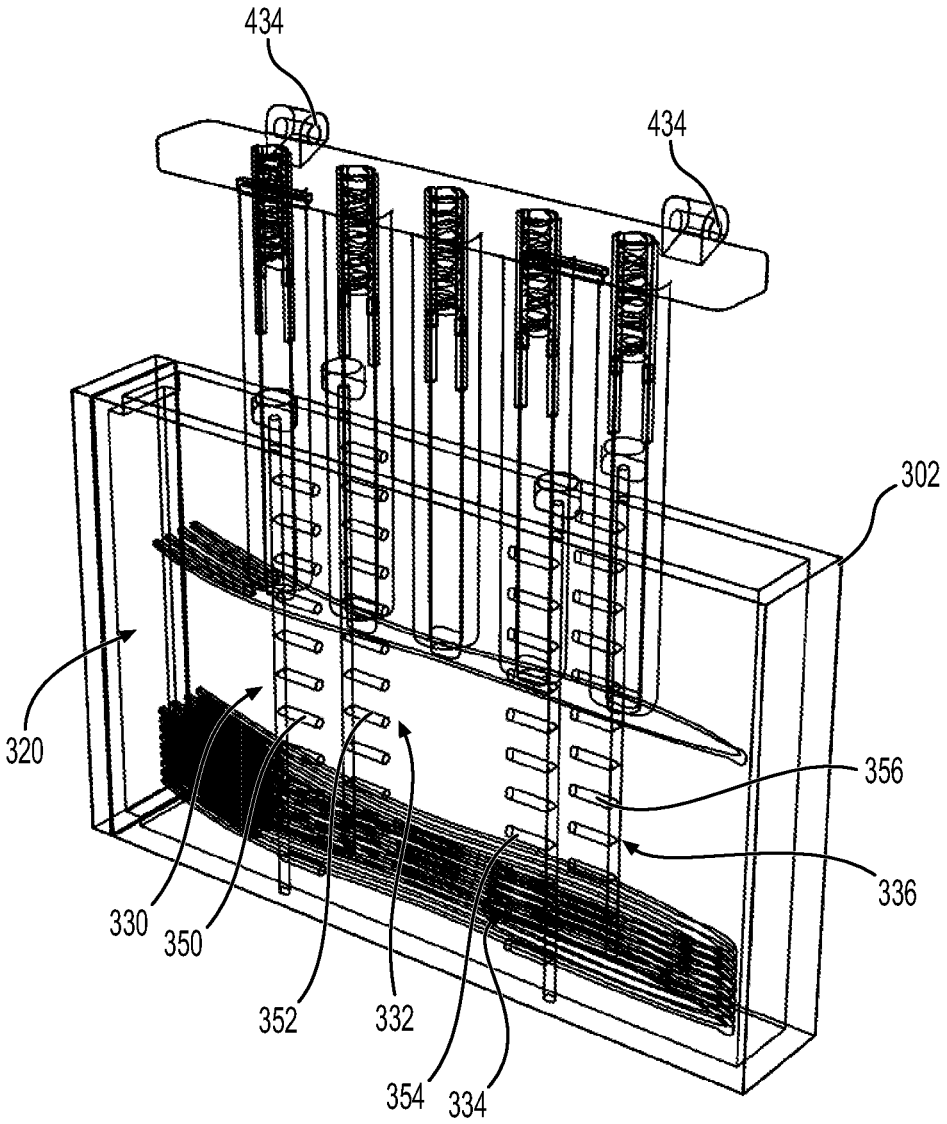
FIG. 19 is a perspective view taken from a front, top, right side of the magazine of FIG. 13, utensils and the base and fingers of the utensil picker of FIG. 18, portions of the magazine and of the utensil picker being shown in transparency.

Referring now to FIG. 16, the sets of dividers 330, 332, 334, 336 when they are in the retracted position will now be described.

In the retracted position, the dividers 350 of the set of dividers 330 and the dividers 352 of the set of dividers 332 extend toward the front side 311. It is contemplated that in some embodiments, the dividers 350, 352 could extend toward the rear side 312 in the retracted position. It is also contemplated that in some embodiments, the dividers 350 could extend toward the rear side 312, whereas the dividers 352 could extend toward the front side 311 or vice-versa. Similarly, the dividers 354 of the set of dividers 334 and the dividers 356 of the set of dividers 336 extend toward the rear side 312. It is contemplated that in some embodiments, the dividers 354, 356 could extend toward the front side 311 in the retracted position. It is also contemplated that in some embodiments, the dividers 354 could extend toward the rear side 312, whereas the dividers 356 could extend toward the front side 311 or vice-versa.

It is contemplated that in some embodiments there could only be two sets of dividers, where one of the sets of dividers is disposed next to the left side 319 and the other set of dividers is disposed next to the right side 320. In such embodiments, one of the sets of dividers is between the front side 311 and the other set of dividers, and in the retracted position, the dividers of one of the sets of dividers extend toward the rear side 312, and the dividers of the other set of dividers extend toward the front side 311.

When the sets of dividers 330, 332, 334, 336 are moved from the holding position to the retracted position while the magazine 302 is storing utensils, and the receptacle 310 is lying on its bottom side 318, as shown in FIG. 16, the utensils that were inserted between the dividers 350, 352, 354, 356 and kept apart from each other, fall in a stack on the bottom side 318. The utensils can be removed from the stack by the opening 317.

Referring to FIGS. 1, 2 and 17 to 20, the utensil picker 400 will now be described in greater detail. In the present embodiment, the utensil picker 400 is adapted to pick up one utensil from each of the magazines 302, 304, 306. It is contemplated that in other embodiments, the utensil picker 400 could pick up more or less utensils from more or less magazines.

The utensil picker 400 has two movable arms 410 that are spaced from one another. In the present embodiment, the utensil picker 400 also has two arms 415, to which the two movable arms 410 are connected. In the present embodiment, the movable arms 410 are movable in the horizontal and vertical directions, along the two arms 415. It is contemplated that in some embodiments, the utensil picker 400 could have more or less than two movable arms 410 and/or could have more or less than two arms 415. In the present embodiment, the arms 410 and 415 are T-tracks. Each arm 410 made of an upper track 411 and a lower track 412.

As the two arms 410 are similar, only one arm 410 and the connections thereof will be described. The lower track 412 is connected to the upper track 411 via a pair of T-slot wheels 413 and a bracket 414. More precisely, the pair of T-slot wheels 413 is connected to the bracket 414, and to the upper track 411. The bracket 414 is fixedly connected to the lower track 412. Thus, when the pair of T-slot wheels 413 is actuated by a motor 418, the pair of T-slot wheels 413 climb the upper track 411 such that the lower track 412 can move up or down the upper track 411. In the present embodiment, the motor 418 is a stepper motor. The upper track 411 is connected to the arm 415 by a pair of T-slot wheels 416 and a bracket 417. More precisely, the pair of T-slot wheels 416 is connected to the bracket 417, and to the arm 415. The bracket 417 is fixedly connected to the upper track 411. Thus, when the pair of T-slot wheels 416 is actuated by a motor 419, the pair of T-slot wheels 416 roll across the arm 415 such that upper track 411 moves along the arms 415. In the present embodiment, the motor 419 is a stepper motor. In the present embodiment, the motors 418, 419 are controlled by the controller 70.

The utensil picker 400 also has three bases 420, 422, 424 that are connected to the two movable arms 410. It is contemplated that in other embodiments, there could be more or less than three bases depending on the number of magazines being used. As the three bases 420, 422, 424 and the features connected thereto are identical, only the base 420 and the features connected thereto will be described in detail herein.

In the present embodiment, the base 420 has an upper portion 430 and a lower portion 432. The upper portion 430 is connected to the two movable arms 410. Two hinges 434 connect the upper portion 430 to the lower portion 432.

In the present embodiment, the utensil picker 400 has five fingers 450 that are arranged in a line and connected under the base 420, to the lower portion 432. It is contemplated that in some embodiments, there could be two, three, four or more fingers connected to the base 420. It is contemplated that in some embodiments, the fingers 450 could be arranged in a shape other than a line.

Each one of the fingers 450 has a housing 460 that is connected to the lower portion 432 of the base 420. Each one of the fingers 450 also includes a spring 452 which is housed in the housing 460. In the present embodiment, the springs 452 can be inserted in their respective housings 460 by pivoting the upper portion 430 relative to the lower portion 432 using the hinges 434, thereby revealing the upper open ends of the housings 460. It is contemplated that in some embodiments, the springs 452 could be other resiliently deformable members. In other embodiments, the springs 452 could be omitted.

Each one of the fingers 450 also includes a fingertip 454 that is connected to a lower end of the spring 452 and that is opposite to the base 420 (i.e., fingertip 454 is below the corresponding base 420). Each one of the fingertips 454 is moveable in a vertical direction with respect to the base 420, and is biased away from the base 420 by the spring 452. In the present embodiment, each one of the fingertips 454 is also slidable in the corresponding housing 460. As will be described in greater detail below, the fingers 450 are adapted to pick up utensils of various shapes.

Each one of the fingers 450 also includes a permanent magnet 456 provided at a lower end of the fingertip 454. It is contemplated that in some embodiments, the permanent magnet 456 could be another type of attachment such as, for instance, an electro-magnet, a suction cup and/or a nozzle that suctions air. As will be described in greater detail below, the permanent magnet 456 is adapted for attaching a utensil to the fingers 450.

In some embodiments, as mentioned above, the springs 452 could be omitted. In such embodiments, a weight of the fingertips 454 and a weight of the corresponding permanent magnets 456 can result in the fingertips 454 being pulled down away from the base 420.

Figure 4:
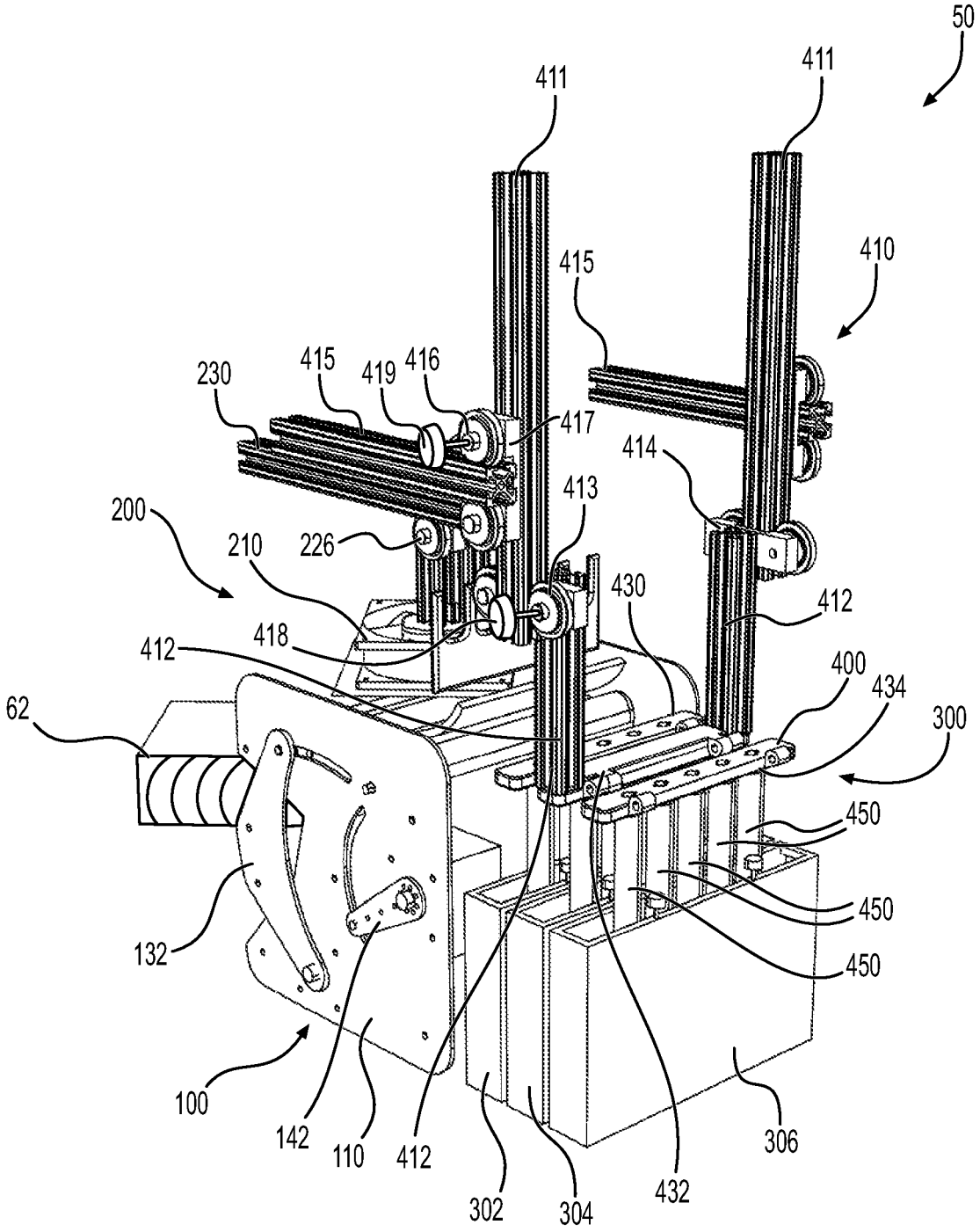
FIG. 4 is a perspective view taken from a front, top, left side of a portion of the apparatus of FIG. 1, in the configuration shown in FIG. 3.

Referring to FIGS. 4 to 6, 19 and 20, the utensil picker 400 as it picks up a utensil from the magazines 302, 304, 306, where the sets of dividers 330, 332, 334, 336 are in the retracted position, will now be described. The two movable arms 410 move the utensil picker 400 such that fingers 450 of each of the bases 420, 422, 424 are respectively aligned with a corresponding one of the magazines 302, 304, 306. As such, when the utensil picker 400 moves vertically down, as shown in FIG. 4, the fingers 450 of the bases 420, 422, 424 are respectively received in the magazines 302, 304, 306. In the present embodiment, the fingers 450 of the base 420 are configured to pick up a single fork, at a time from the magazine 302, the fingers 450 of the base 422 are configured to pick up a single spoon at a time from the magazine 304 and the fingers 450 of the base 424 are configured to pick up a single knife at a time from the magazine 306. It is contemplated that in some embodiments, the fingers 450 of one of the bases 420, 422, 424 could be configured to pick up more than one utensil at a time.

Focusing now on the base 420 and the features connected thereto, as mentioned above, the fingers 450 can pick up utensils of various shapes. When the utensil being picked up is not flat, the fingertips 454 can move in their housings 460 to partially conform to the shape of the utensil. As such, when the utensil has a portion extending toward the fingers 450, the fingertips 454 can slide inwards.

Figure 20:
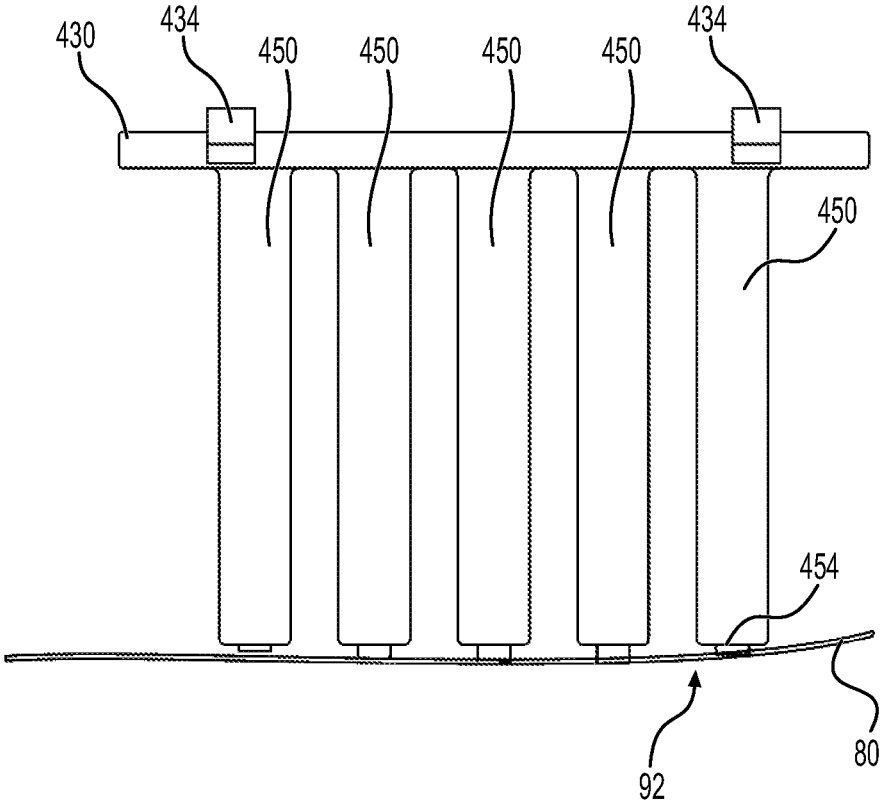
FIG. 20 is a left side elevation view of the base and fingers of the utensil picker of FIG. 18 with a fork connected thereto.

For instance, referring to FIG. 20, where the fork 80 has a curved handle 92, the fingertip 454 retract in the housings 460 toward the base 420 to conform to the shape of the handle 92. More specifically, as can be seen for this shape of handle 92, the outer fingertips 454 are more retracted in their respective housings 460 than the three central fingertips 454. This allows the fingers 450 to connect to the utensil at multiple points and helps ensure that the utensil will be picked up by the utensil picker 400. As mentioned above, the utensil picker 400 can pick up utensils of various shapes.

Referring to FIGS. 1 to 6 and 21, in the present embodiment, the apparatus 50 also has a comb 500 and a chute 550 which will now be described in greater detail. The comb 500 is disposed above the wrapping assembly 100, while the chute 550 is disposed vertically between the comb 500 and the wrapping assembly 100. It is contemplated that in some embodiments, the comb 500 and/or the chute 550 could be omitted.

Figure 21:
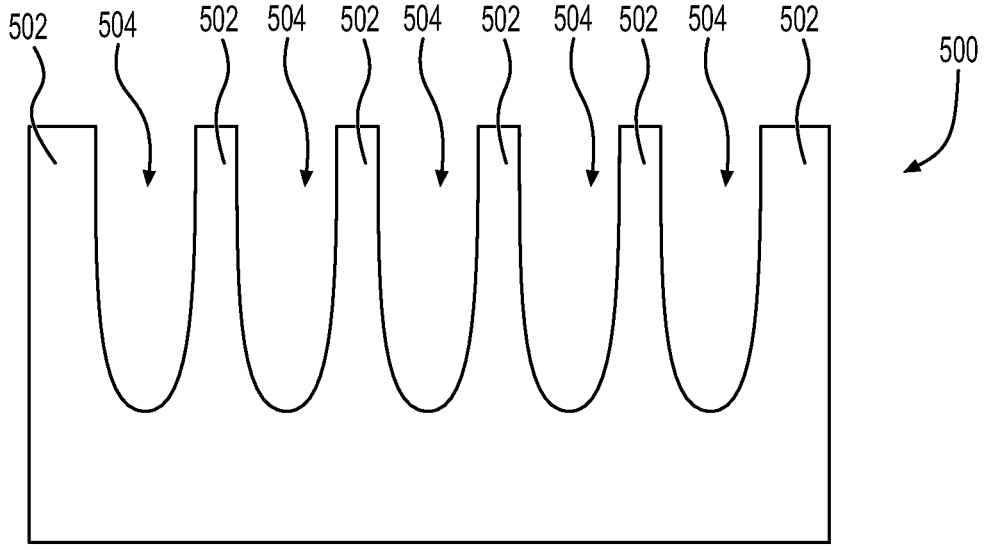
FIG. 21 is a right side elevation view of a comb of the apparatus of FIG. 1.
Figure 22:
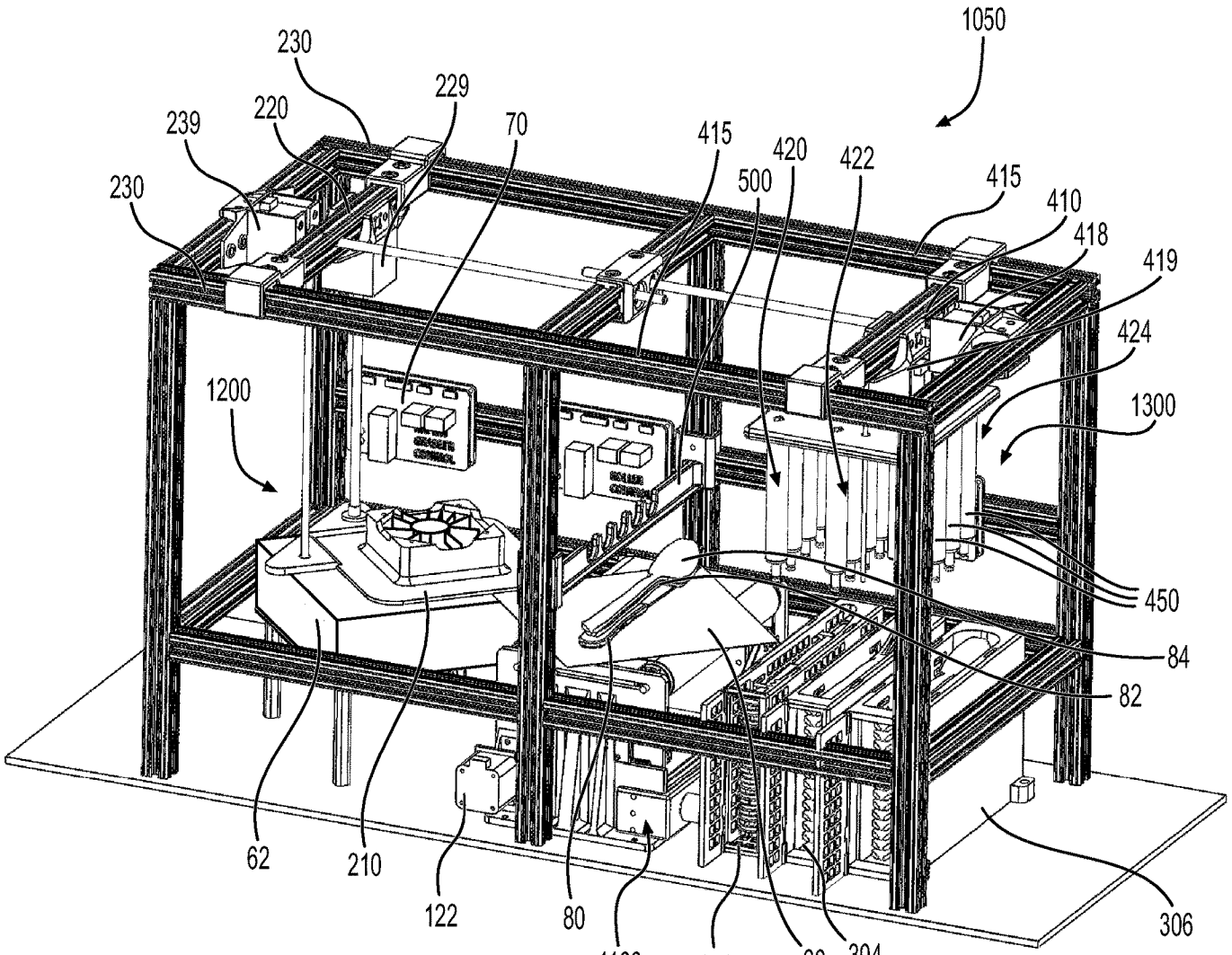
FIG. 22 is a perspective view taken from a front, top, left side of an alternative embodiment of an apparatus for wrapping a napkin around utensils.
Figure 23:
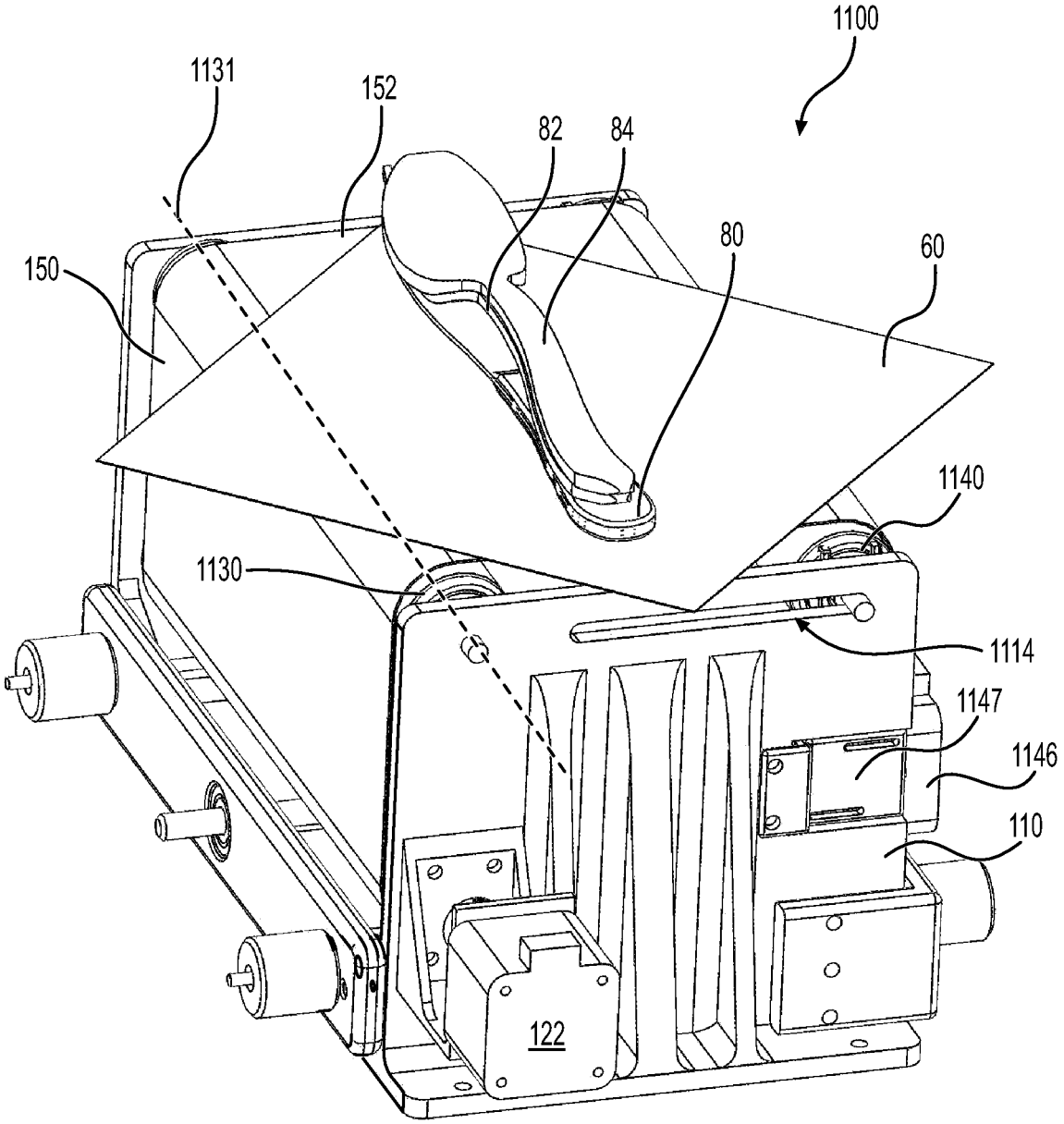
FIG. 23 is a perspective view taken from a front, top, right side of a wrapping assembly of the apparatus of FIG. 22 with a napkin and utensils being disposed thereon and the wrapping assembly being in an initial configuration.

The comb 500, which in the present embodiment is connected to the frame 110, has six upwardly extending teeth 502 that define five spaces 504 (best seen in FIG. 21). It is contemplated that in some embodiments, the number of teeth and spaces could be different than illustrated. The five spaces 504 are adapted for each receiving one of the five fingers 450 therethrough.

The chute 550, which in the present embodiment is also connected to the frame, is curved. It is contemplated that in other embodiments, the chute 550 could be a flat surface. The chute 550 is oriented such that the utensils falling thereon are guided to fall on the wrapping assembly 100.

As will be described in greater detail below, in the present embodiment, when the utensil picker 400 has picked up utensils, and the movable arms 410 move the fingers 450 through the spaces 504 in the comb 500, the teeth 502 of the comb 500 separate the utensils from the ends of the fingers 450 as the fingers 450 pass through the comb 500 and the utensils fall toward the chute 550. The chute 550 then slows the fall of the utensils and directs them onto the wrapping assembly 100. It is contemplated that in embodiments where the comb 500 is omitted, the movable arms 410 would move the utensil picker 400 until it is aligned with the chute 550, and drop the utensils thereon via some other mechanism.

Referring back to FIGS. 1 to 11, a method for providing three utensils 80, 82, 84 wrapped in the napkin 60 will be described.

Figure 2:
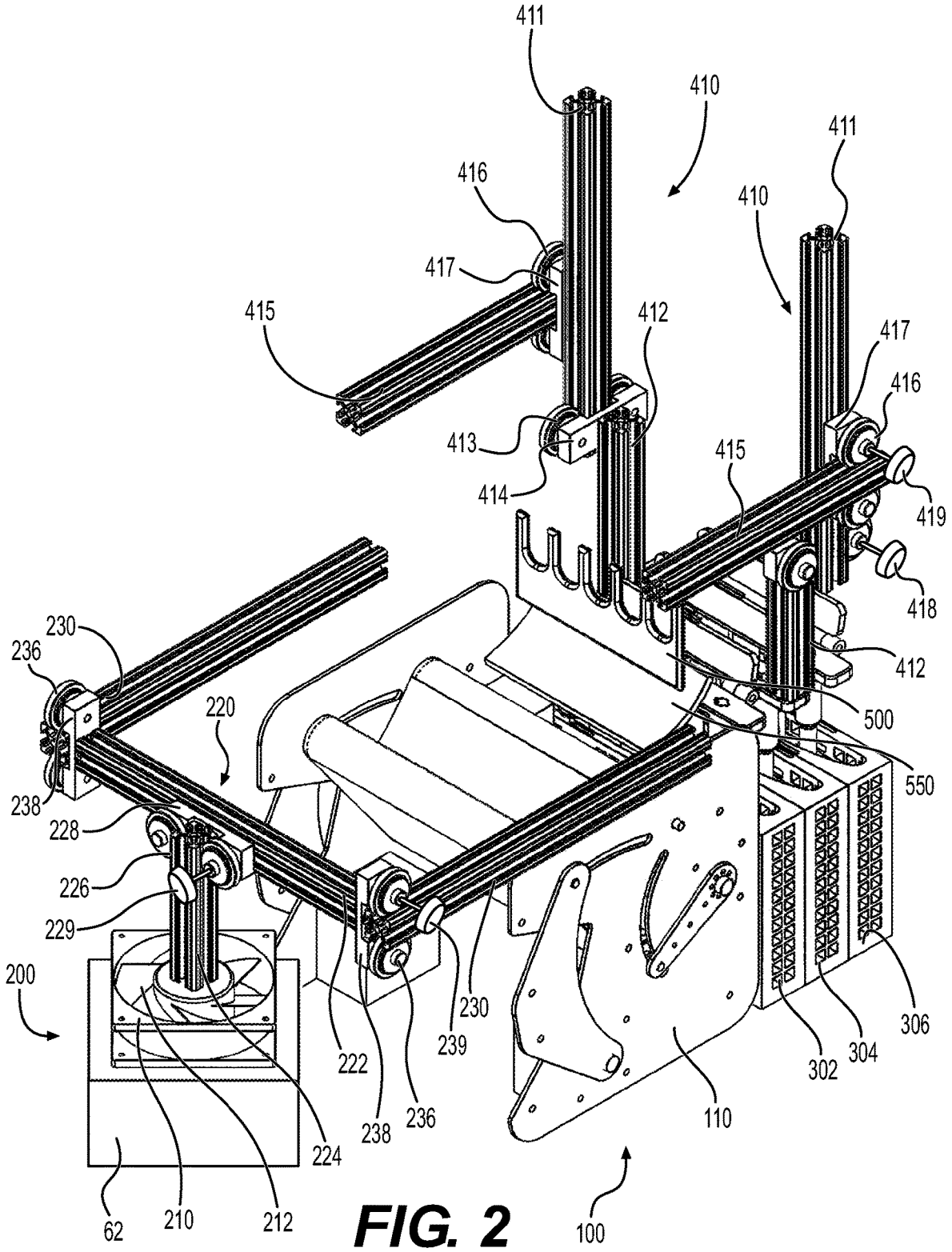
FIG. 2 is a perspective view taken from a front, top, right side of a portion of the apparatus of FIG. 1, with a napkin delivery assembly of the apparatus of FIG. 1 having picked up a napkin and a utensil picker of the apparatus picking up utensils from magazines.
Figure 3:
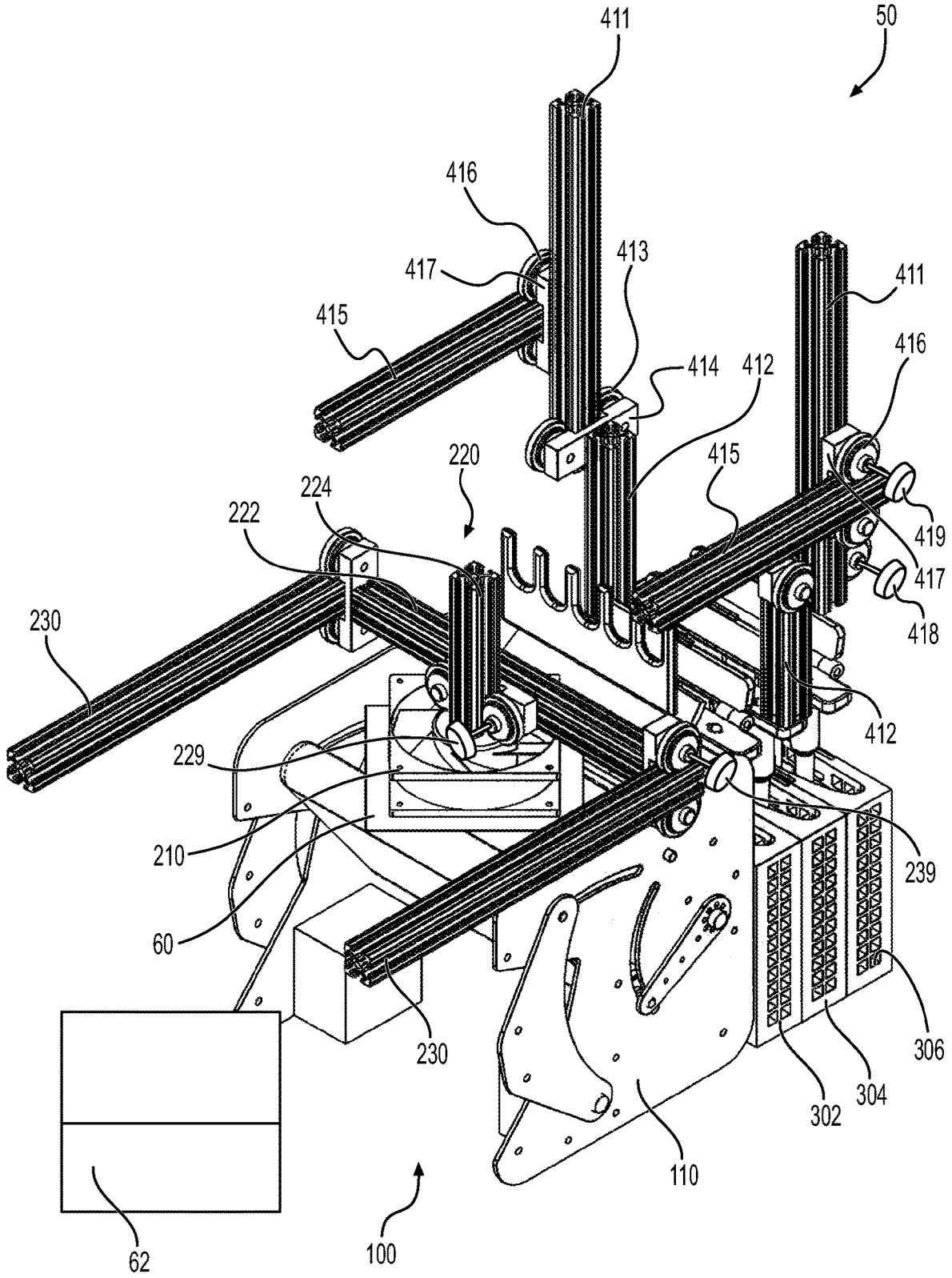
FIG. 3 is a perspective view taken from a front, top, right side of a portion of the apparatus of FIG. 1, with the napkin delivery assembly being above a wrapping assembly of the apparatus of FIG. 1.

Referring to FIGS. 1 to 3, the method includes placing the napkin 60 on the wrapping assembly 100, with the wrapping assembly 100 in the initial configuration. This includes picking up a napkin 60 from the stack of napkins 62 with the fan 210, by turning the fan 210 on when the fan 210 is above the stack of napkins 62. The fan 210, and thus the napkin 60, then moves from the stack of napkin 62, until the fan 210 is above the wrapping assembly 100. The napkin 60 is then placed on the portion 152 of the wrapping assembly 100 by turning off the fan 210. The fan 210 is then returned to the stack of napkins 62.

Figure 5:
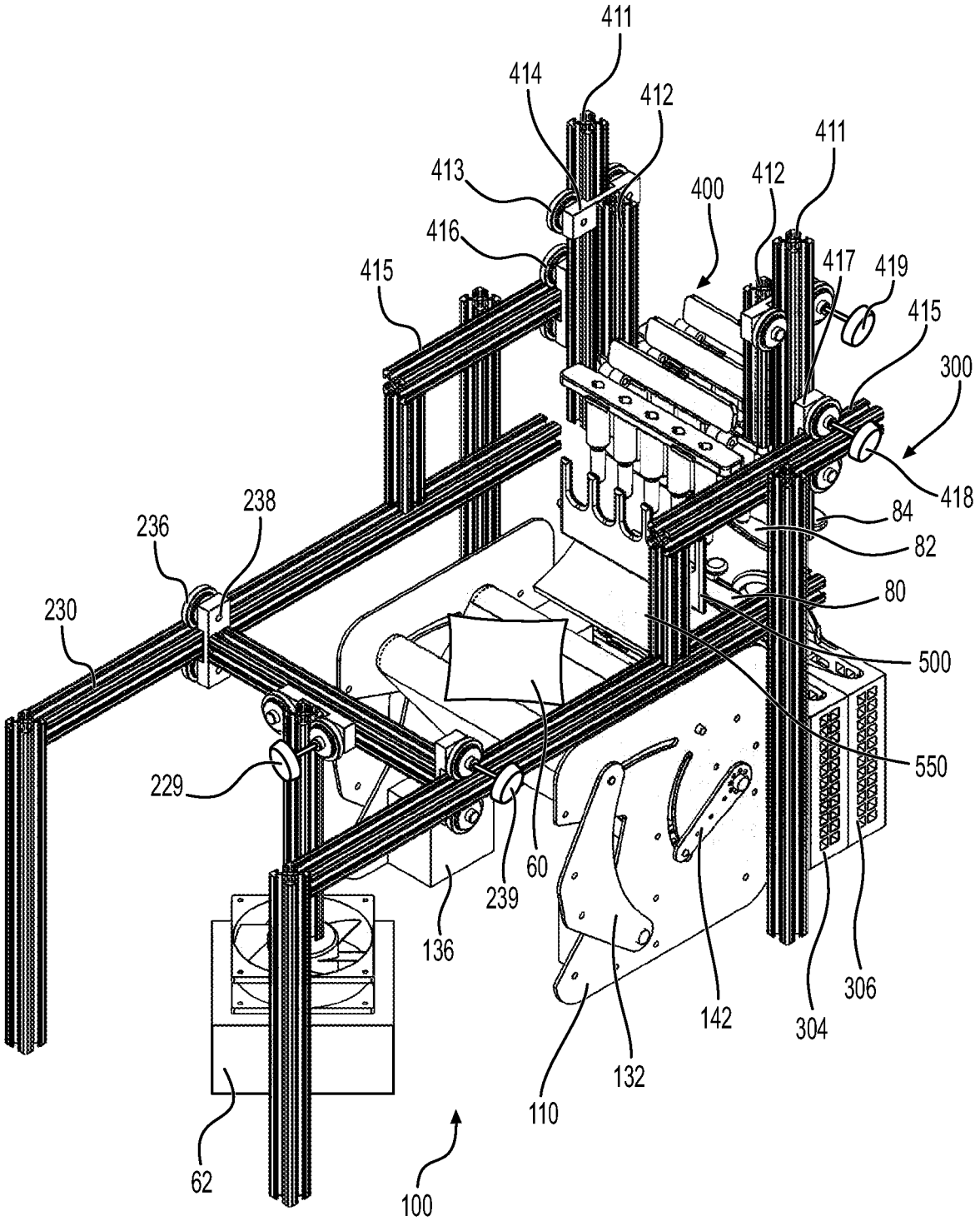
FIG. 5 is a perspective view taken from a front, top, right side of the apparatus of FIG. 1 with the napkin being disposed on the wrapping assembly, and the utensil picker being above the wrapping assembly, and interacting with a comb of the apparatus of FIG. 1.
Figure 6:
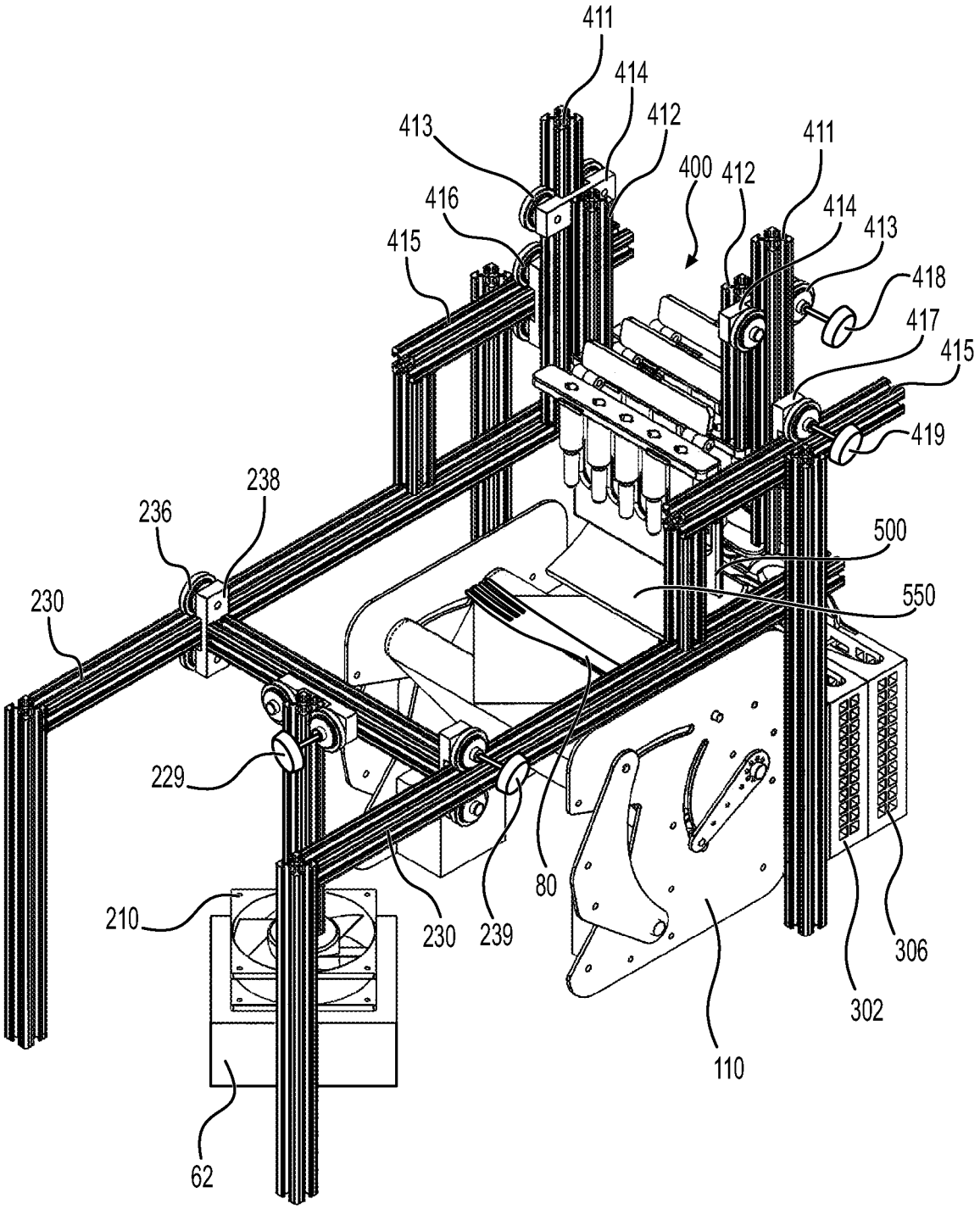
FIG. 6 is a perspective view taken from a front, top, right side of the apparatus of FIG. 1, with the napkin and a fork being disposed on the wrapping assembly.
Figure 7:
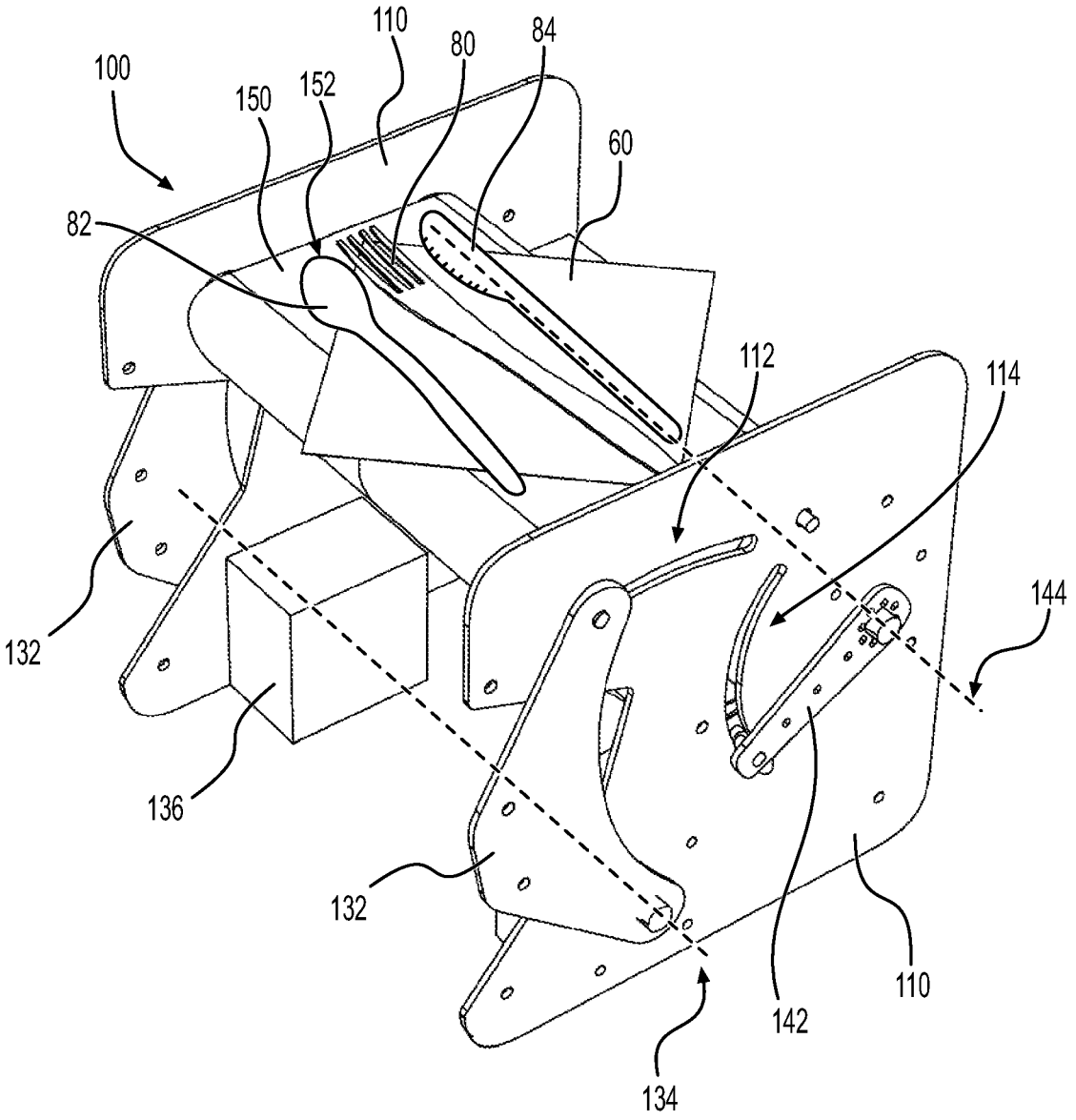
FIG. 7 is a perspective view taken from a front, top, right side of the wrapping assembly of the apparatus of FIG. 1 with the napkin and utensils being disposed thereon.

Referring to FIGS. 4 to 6, then the three utensils: a fork 80, a spoon 82 and a knife 84 are to be placed on the napkin 60. In the present embodiment, this includes picking up the three utensils 80, 82, 84 with the utensil picker 400 from the magazines 302, 304, 306. It is contemplated that in some embodiments, the utensil picker 400 could pick more or less than the three utensils 80, 82, 84. More precisely, in the present embodiment, the movable arms 410 move the utensil picker 400 such that the fingers 450 of the bases 420, 422, 424 are aligned with the magazines 302, 304, 306. The movable arms 410 then move the utensil picker 400 downwardly such that the fingers 450 are received into the magazines 302, 304, 306. In the present embodiment, the permanent magnets 456 of the fingers 450 of the base 420 that are received in the magazine 302 connect to the fork 80, the permanent magnets 456 of the fingers 450 of the base 422 that are received in the magazine 304 connect to the spoon 82 and the permanent magnets 456 of the fingers 450 of the base 424 that are received in the magazine 306 connect to the knife 84. The movable arms 410 then move upwardly until the fingers 450 are vertically aligned with the spaces 504 of the comb 500. The movable arms 410 then move toward the comb 500.

The fork 80, spoon 82 and knife 84 are then dropped on the chute 550 that is disposed above the wrapping assembly 100. The fork 80, the spoon 82 and the knife 84 are dropped from the utensil picker 400 onto the chute 550, as the fingers 450 pass through the spaces 504, and the fork 80, the spoon 82 and the knife 84 encounter the comb 500 which separates them from the fingers 450. It is contemplated that there could be more or less than three utensils being placed on the napkin 60.

Figure 9:
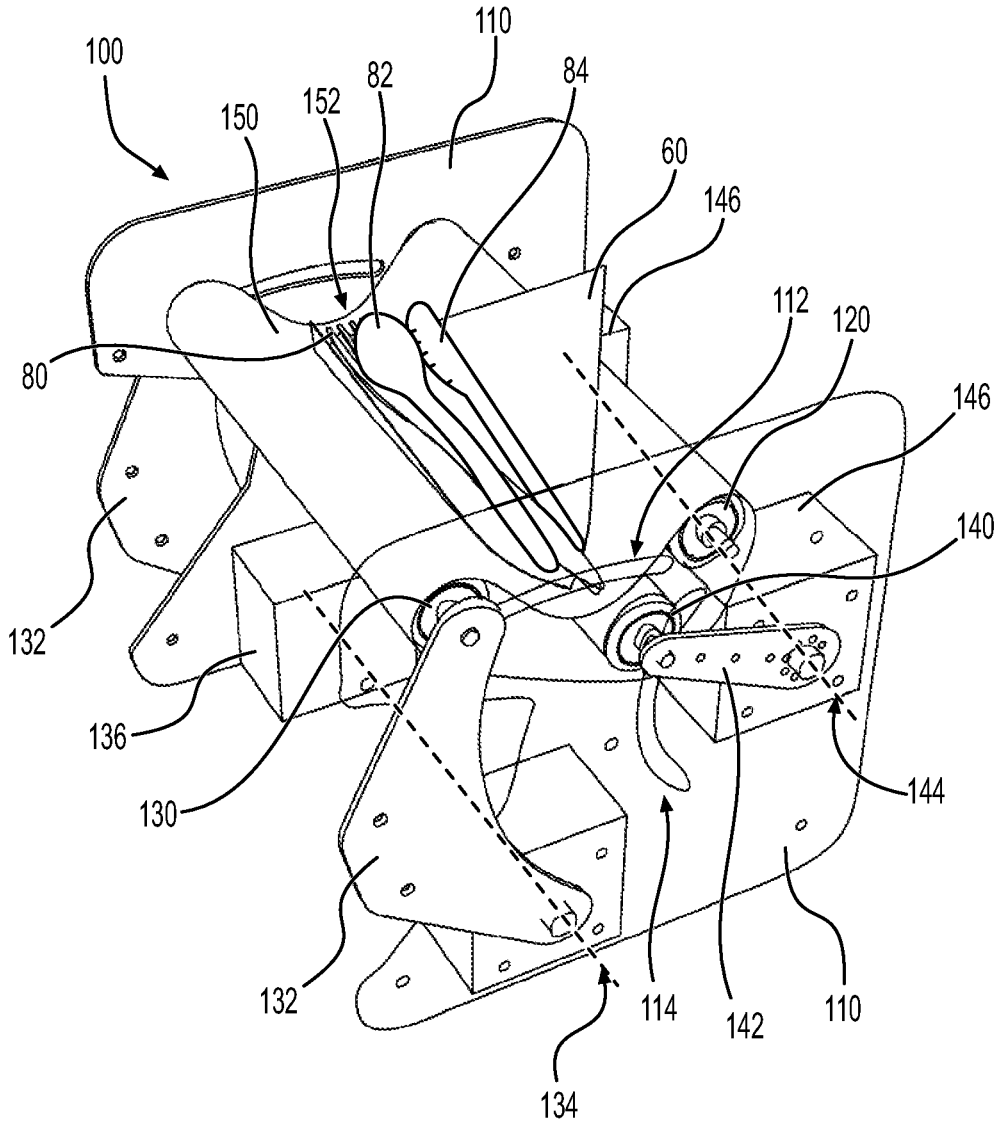
FIG. 9 is a perspective view taken from a front, top, right side of the wrapping assembly of FIG. 7 in a folding configuration.

Once the utensils 80, 82, 84 are on the napkin 60, the wrapping assembly 100 is configured in the folding configuration, as shown in FIG. 9, by lifting the lower idler roller 140 in an arcuate path, as described above. This causes the endless belt 150 to sag between the driven roller 120 and the upper idler roller 130, and thereby causes the napkin and the utensils 80, 82, 84 to be received in the sag.

Figure 10:
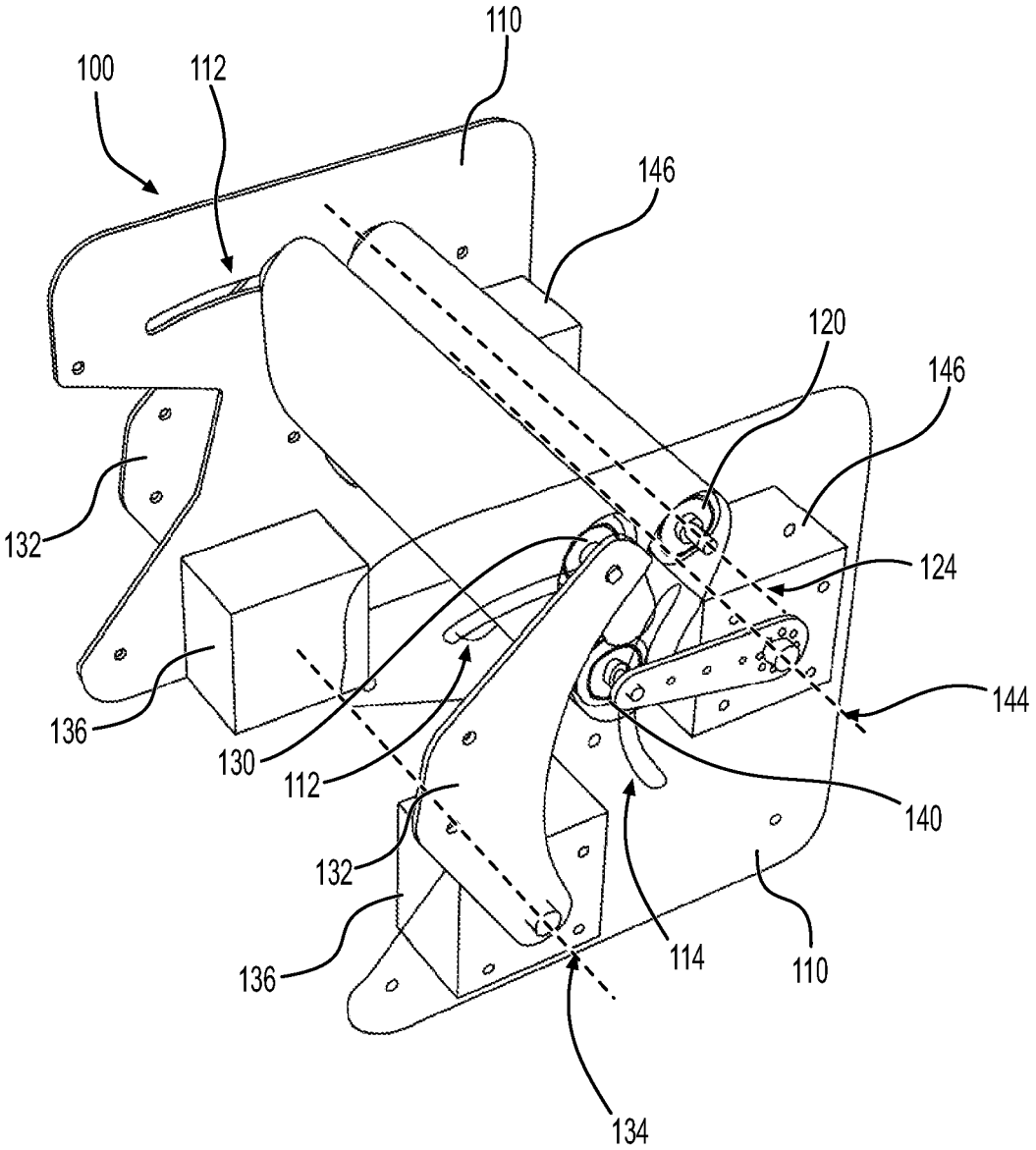
FIG. 10 is a perspective view taken from a front, top, right side of the wrapping assembly of FIG. 7 in a wrapping configuration.
Figure 11:
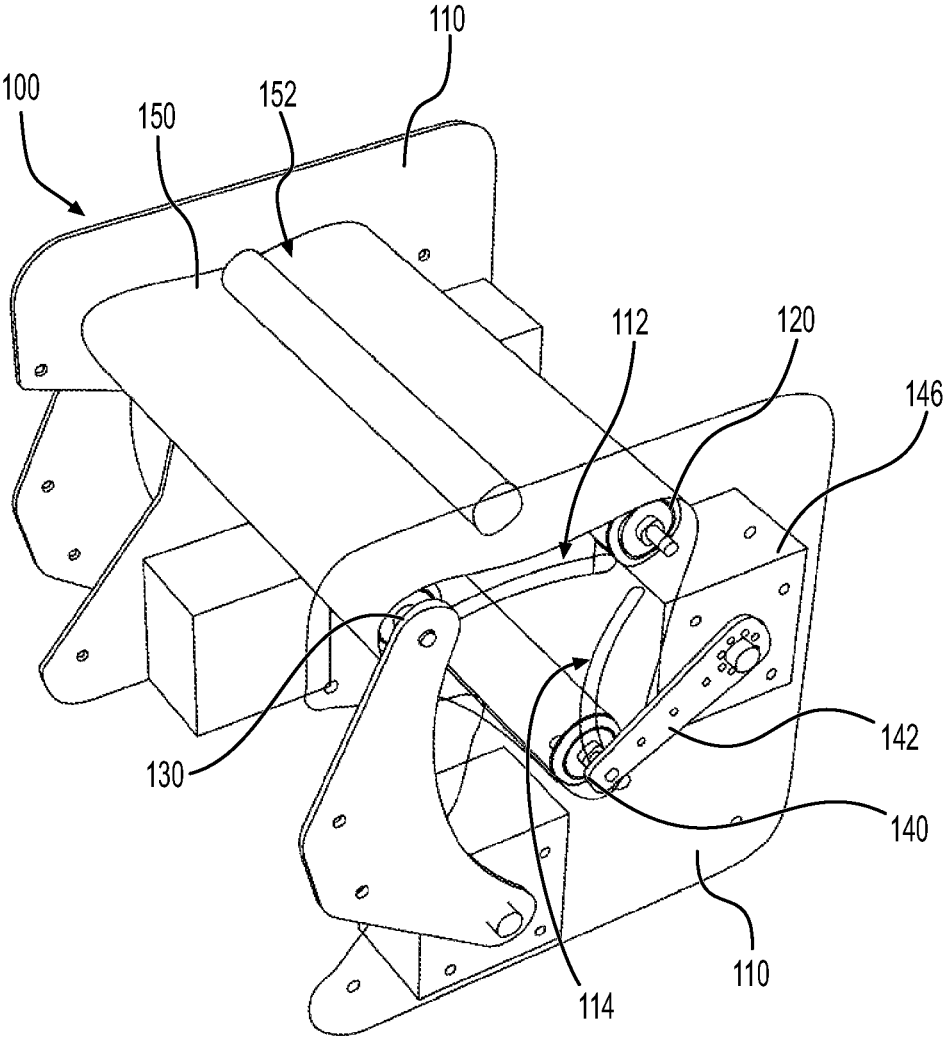
FIG. 11 is a perspective view taken from a front, top, right side of the wrapping assembly of FIG. 7 back in the initial configuration, and the utensils being wrapped in the napkin.

The wrapping assembly 100 is then configured in the wrapping configuration, as shown in FIG. 10, by moving the upper idler roller 130 toward the driven roller 120 in an arcuate path, and by lowering the lower idler roller 140 in an arcuate path to increase the tension in the endless belt 150 as described above.

The endless belt 150 is then turned around the driven roller 120, the upper idler roller 130 and the lower idler roller 140 by the motor 122 rotating the driver roller 120, thereby wrapping the napkin 60 around the fork 80, the spoon 82 and the knife 84. Once the endless belt 150 has moved sufficiently to properly wrap the napkin 60 around the fork the spoon 82 and the knife 84, the motor 122 is stopped, thereby stopping to turn the endless belt 150. This could be determined by a predetermined amount of time by which the motor 122 is to be operated or by a predetermined number of rotation of the driven roller or by some other factor.

The wrapping assembly 100 is then returned to the initial configuration by moving the upper idler roller 130 away from the driven roller 120 in an arcuate path, and by lowering the lower idler roller 140. This causes the fork 80, the spoon 82 and the knife 84 that are wrapped in the napkin 60 to be disposed on the flat horizontal portion 152 of the endless belt 150. It is contemplated that a taping apparatus could be added to apply tape, or a band of paper with adhesive, around the napkin 60 to secure the napkin 60 around the utensils 80, 82, 84. The wrapped utensils are then removed manually from the wrapping assembly 100. It is contemplated that an automated mechanism could be used to pick up the wrapped utensils from the wrapping assembly 100. It is also contemplated that the motor 122 of the wrapping assembly 100 could be turned on to move the wrapped utensils off the endless belt 150 into a basket or some other receptacle.

It is contemplated that in some embodiments, some of the steps of the methods could be done simultaneously, so long as the napkins are delivered to the endless belt 150 before the utensils In the present embodiment, the method described above is automated by the controller 70.

It is contemplated that the wrapping assembly 100 could be used without the napkin delivery assembly 200 or without the utensil delivery assembly 300 or without both. It is also contemplated that in some embodiments, the apparatus 50 could have one or two of the wrapping assembly 100, the napkin delivery assembly 200 and the utensil delivery assembly 300, but with one or two of a wrapping assembly, a napkin delivery assembly and a utensil delivery assembly that is/are different from the ones described above. Similarly, it is contemplated that in some embodiments the magazines 302, 304, 306 could be used with a different type of utensil picker and that the utensil picker 400 could be used with a different type of magazines.

Referring now to FIGS. 22 to 26, an alternative embodiment of the apparatus 50, namely apparatus 1050, includes a wrapping assembly 1100, a napkin delivery assembly 1200, a utensil delivery assembly 1300 and the comb 500. Similarly to the apparatus 50, the napkin delivery assembly 1200 is configured to deliver the napkin 60 to the wrapping assembly 1100. The utensil delivery assembly 1300 along with the comb 500 are configured to deliver the utensils 80, 82, 84 to the wrapping assembly 1100 on the napkin 60 delivered by the napkin delivery assembly 1200. In the present embodiment, the chute 550 is omitted, such that when the utensils 80, 82, 84 picked up by the utensil delivery assembly 1300 encounter the comb 500 and are dropped, the utensils 80, 82, 84 fall directly on the wrapping assembly 1100, rather then falling on the chute 550 and then falling on the wrapping assembly 1100. The wrapping assembly 1100 is configured to wrap the napkin 60 around the utensils 80, 82, 84.

Features of the apparatus 1050, the wrapping assembly 1100, the napkin delivery assembly 1200 and the utensil delivery assembly 1300 that are, respectively, generally similar to those of the apparatus 50, the wrapping assembly 100, the napkin delivery assembly 200 and the utensil delivery assembly 300 described above have been labeled with the same reference numerals and will not be described again in detail. That being said, the configuration of the apparatus 1050 differs slightly from the configuration of the apparatus 50. For instance, the configuration of the arms 220, 230 of the napkin delivery assembly 1200 are different from the configuration of the arms 220, 230 of the napkin delivery assembly 200 and the configuration of the arms 410, 415 of the utensil delivery assembly 1300 are different from the configuration of the arms 410, 415 of the utensil delivery assembly 1300. Additionally, the motors 229, 239 of the napkin delivery assembly 1200, and the motors 418, 419 of the utensil delivery assembly 1300 have been replaced by motorized lead screw actuators. Actuation of the motorized lead screw actuators 229, 239, 418, 419 result in the movement of the napkin delivery assembly 1200 and the utensil delivery assembly 1300. Limit switches (not shown) control the motorized lead screw actuators 229, 239, 418, 419 to limit movement of the napkin delivery assembly 1200 and the utensil delivery assembly 1300.

Turning to FIGS. 23 to 26, the wrapping assembly 1100 has a driven roller 1120, an idler roller 1130 and an idler roller 1140, all three of which are rotationally connected to the frame 110. An endless belt 150 is wrapped around the driven roller 1120 and the idler rollers 1130, 1140.

In the present embodiment, the driven roller 1120, which is operatively connected to the motor 122, is vertically below the idler rollers 1130, 1140, whereas the idler rollers 1130, 1140 are generally vertically aligned with one another. It is contemplated that in some embodiments, the motor 122 could be connected to another one of the rollers. For instance, in other embodiments, the idler roller 1130 could be configured to be the driven roller.

The idler roller 1130 is disposed inside the frame 110, and is rotationally connected thereto about a rotation axis 1131, which is fixed relative to the frame 110.

The idler roller 1140 is disposed inside the frame 110, and is connected to the frame 110 via a movable member 1142 (best seen in FIG. 25) that is also disposed inside the frame 110. Ends of a shaft of the idler roller 1140 extends out through a pair of rectilinear slots 1114 that are defined in the frame 110. The movable member 1142 is configured to move along a rectilinear path in the slots 1114 with respect to the frame 110. An actuator 1146 is operatively connected to the movable member 1142. In the present embodiment, the actuator 1146 is a motorized lead screw actuator, though it is contemplated that other types of actuators 1146 could be used. The actuator 1146 is operatively connected to limit switches 1147 which are configured to control the actuator 1146. Upon actuation of the actuator 1146, the moveable member 1142 moves in a rectilinear path, guided by the slots 1114, which results in the movement of the idler roller 1140.

The idler roller 1140 is movable between an initial position a wrapping position. It is contemplated that in some embodiments, the idler roller 1140 could be moved to positions intermediate these two positions. In the initial position (shown in FIG. 23), the idler roller 1140 is furthest to the driven roller 1120 and to the idler roller 1130. As the idler roller 1140 moves from the initial position toward the wrapping position, the idler roller 1140 gets closer to the driven roller 1120 and to the idler roller 1130. In the wrapping position (shown in FIG. 25), the idler roller 1140 is closest to the driven roller 1120 and to the idler roller 1130. Thus, upon actuation of the actuator 1146, the idler roller 1140 moves from the initial position toward the wrapping position or vice-versa. In some embodiments, the idler roller 1140 could be configured to stop at a position intermediate to the initial and wrapping positions. The limit switches 1147 are configured to determine when the idler roller 1140 reaches the initial and wrapping positions, and to control the actuator 1146 to stop the actuator 1146 once the initial or wrapping positions are reached.

In the initial configuration (seen in FIG. 23), the idler roller 1140 is in its initial position. In this configuration, the endless belt 150 is in tension about the driven roller 1120 and the idler rollers 1130, 1140. In the initial configuration, the portion 152 of the endless track 150 extending between the idler rollers 1130, 1140 defines a generally flat surface.

Intermediate to the initial and wrapping configurations, (seen in FIG. 24), the positioning of the idler roller 1140 results in the endless belt 150 not being in tension between the idler rollers 1130, 1140. The portion 152 of the endless belt extending between the idler rollers 1130, 1140 droops to define a V-shape where the napkin 60 and the utensils 82, 84 are configured to be received at a bottom of the V-shape.

In the wrapping configuration (seen in FIG. 25), the idler roller 1140 is in its wrapping position. The position of the idler roller 1140 results in the portion 152 of the endless belt 150 extending generally downward from the idler roller 1130 to a low point, and generally upward from the low point to the idler roller 1140. The endless belt 150 is configured to be taut compared to when the wrapping apparatus 1050 is intermediate to the initial and wrapping configures, in part due to the weight of the utensils 80, 82, 84.

The apparatus 1050 is configured to, by using the napkin delivery assembly 1200 and the utensil delivery assembly 1300, place a napkin and utensils on the wrapping assembly 1100. As the method for accomplishing this is similar to the method for apparatus it will not be re-described in detail herewith.

Figure 24:
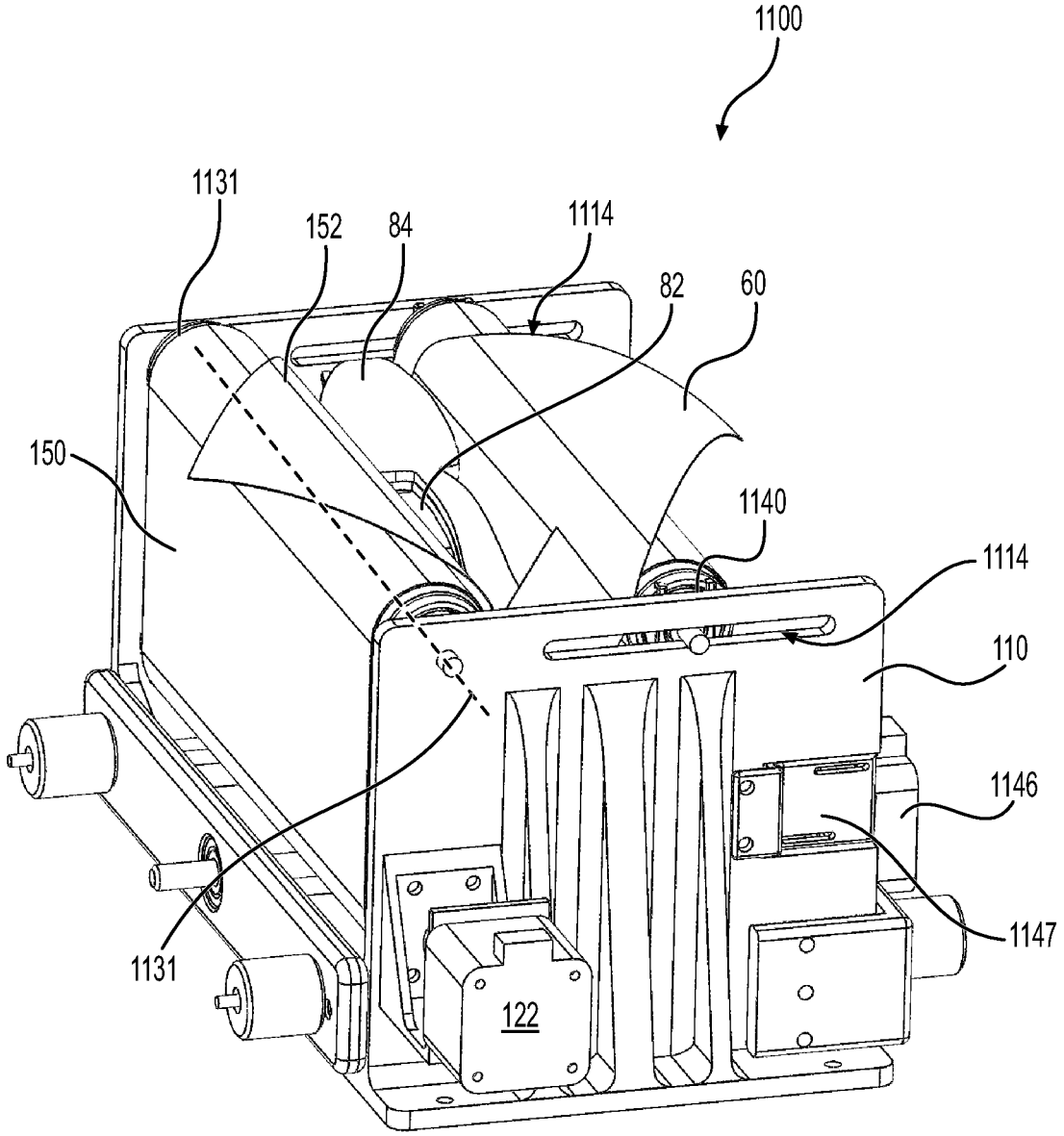
FIG. 24 is a perspective view taken from a front, top, right side of the wrapping assembly of FIG. 23 in a configuration intermediate to the initial configuration and a wrapping configuration.

Once utensils 80, 82, 84 are placed on the napkin 60, as shown in FIG. 24, the idler roller 1140 is moved toward the idler roller 1130, as described above. This causes the endless belt 150 to sag between the idler rollers 1130, 1140, and thereby causes the napkin and the utensils 80, 82, 84 to be received in the sag.

Figure 25:
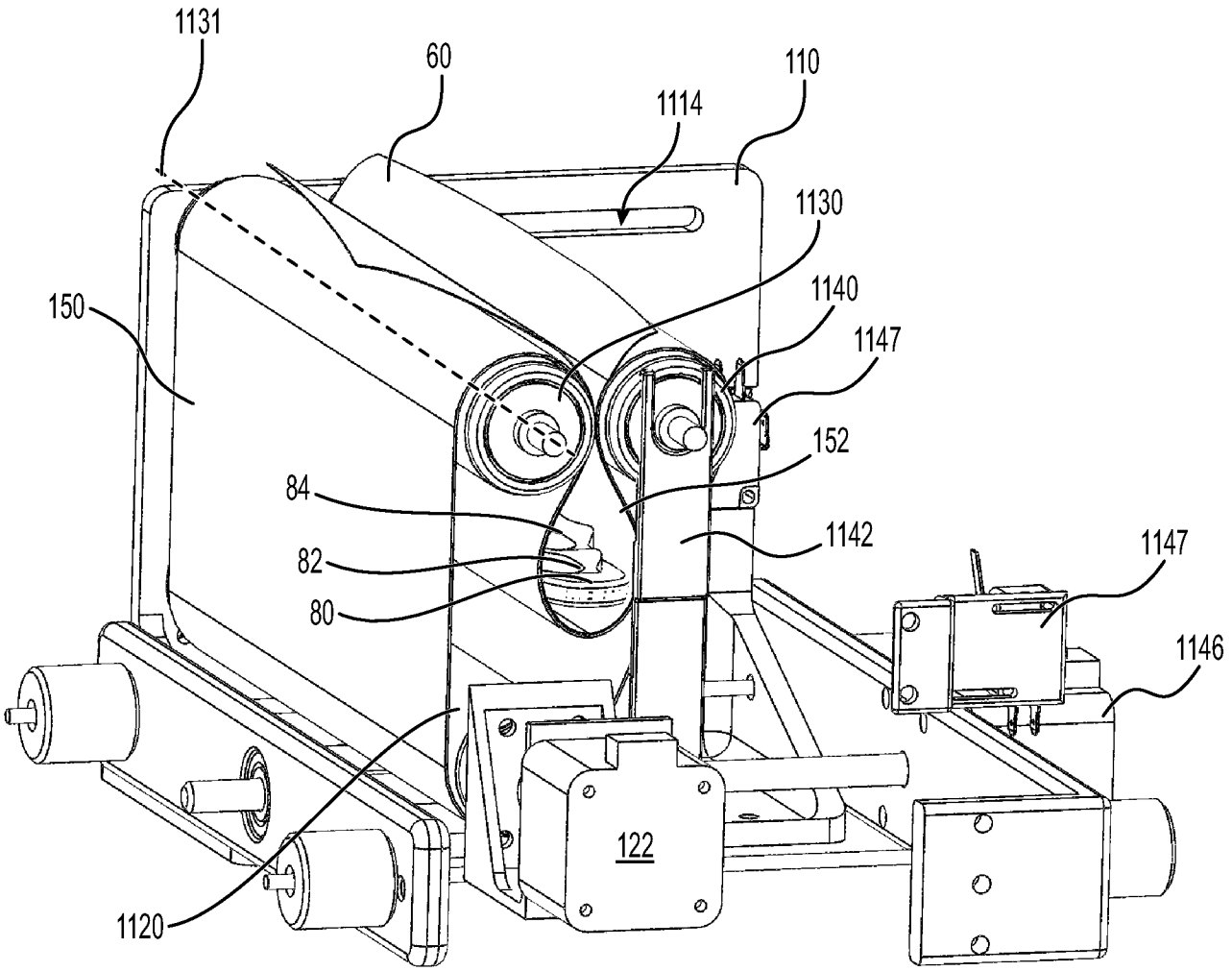
FIG. 25 is a perspective view taken from a front, top, right side of the wrapping assembly of FIG. 23 in the wrapping configuration, and with a front portion of a frame of the wrapping assembly being omitted.

Eventually, when the idler roller 1140 reaches the wrapping position, the wrapping assembly 1100 is in the wrapping configuration, as shown in FIG. 25.

The endless belt 150 is then turned around the driven roller 1120 and the idler rollers 1130, 1140 by the motor 122 rotating the driver roller 1120, thereby wrapping the napkin 60 around the utensils 80, 82, 84. Once the endless belt 150 has moved sufficiently to properly wrap the napkin 60 around the utensils 80, 82, 84, the motor 122 is stopped, thereby stopping to turn the endless belt 150.

Figure 26:
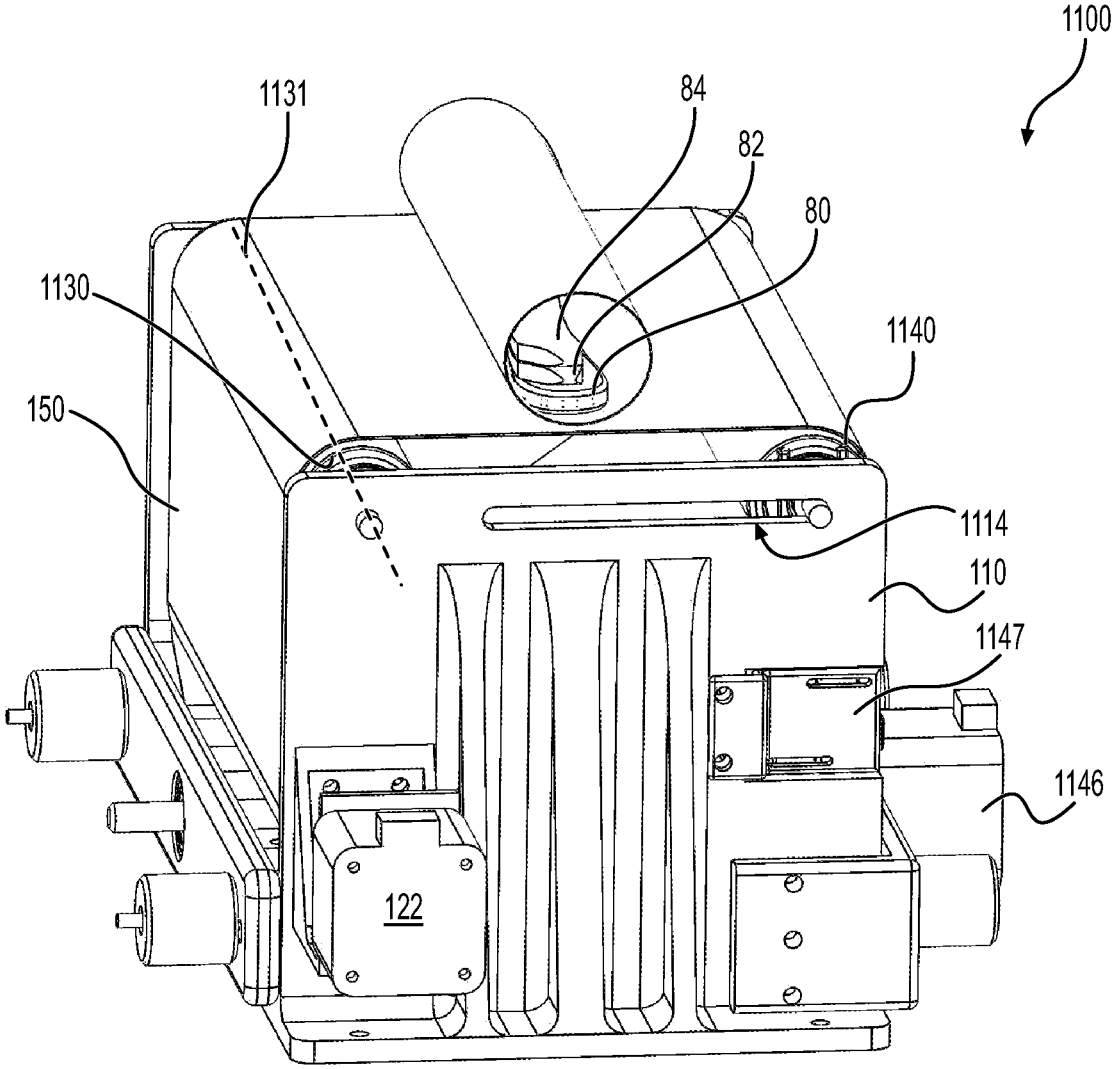
FIG. 26 is a perspective view taken from a front, top, right side of the wrapping assembly of FIG. 23 back in the initial configuration, and the utensils being wrapped in the napkin.

The wrapping assembly 100 is then returned to the initial configuration by moving the idler roller 1140 away from the driven roller 1120 and the idler roller 1130, toward the initial position. This causes the utensils 80, 82, 84 that are wrapped in the napkin to be disposed on the generally flat horizontal portion 152 of the endless belt 150 as shown in FIG. 26.

Similarly to the apparatus 50, the method described hereabove with reference to the apparatus 1050 is automated by the controller 70.

Modifications and improvements to the above-described embodiments of the present technology may become apparent to those skilled in the art. The foregoing description is intended to be exemplary rather than limiting. The scope of the present technology is therefore intended to be limited solely by the appended claims.

What is claimed is:

1. A method for providing at least one utensil wrapped in a napkin, the method comprising:

placing the napkin on a wrapping assembly in an initial configuration, the wrapping assembly comprising:

a frame;

a first roller mounted to the frame;

a second roller mounted to the frame;

a third roller mounted to the frame vertically lower than the first and second rollers; and an endless belt wrapped around the first, second and third rollers, in the initial configuration:

the first roller being generally vertically aligned with the second roller, and the endless belt being in tension about the first, second and third rollers, the napkin being placed on a portion of the endless belt extending between the first and second rollers;

after placing the napkin on the wrapping assembly, placing the at least one utensil on the napkin, after placing the at least one utensil on the napkin, moving the second roller toward the first roller, thereby:

causing the endless belt to sag between the first and second rollers, and causing the napkin and the at least one utensil to be received in a resulting sag;

after moving the second roller toward the first roller, turning the endless belt around the first, second and third rollers thereby wrapping the napkin around the at least one utensil;

once the at least one utensil is wrapped in the napkin, stopping to turn the endless belt; and after stopping to turn the endless belt, returning the wrapping assembly to the initial configuration by moving the second roller away from the first roller, thereby causing the at least one utensil wrapped in the napkin to be disposed on the portion of the endless belt extending between the first and second rollers.

2. The method of claim 1, wherein placing the at least one utensil on the napkin comprises placing a plurality of utensils on the napkin.

3. The method of claim 1, wherein the second roller is moved toward and away from the first roller about a rectilinear path.

4. The method of claim 1, further comprising picking up the napkin from a stack of napkins.

5. The method of claim 4, wherein picking up the napkin from the stack of napkins comprises picking up the napkin using a fan.

6. The method of claim 1, further comprising picking up the at least one utensil from at least one magazine storing a plurality of utensils.

7. The method of claim 6, wherein picking up the at least one utensil comprises picking up the at least one utensil using a utensil picker having a magnet.

8. The method of claim 1, wherein the first roller rotates about an axis of rotation that is fixed relative to the frame.

9. An apparatus for wrapping a napkin around at least one utensil comprising:

a frame;

a first roller rotationally connected to the frame;

a second roller rotationally connected to the frame, the second roller being movable between a first position and a second position, in the first position the second roller being generally vertically aligned with the first roller, the second roller being closer to the first roller in the second position than in the first position in a horizontal direction;

an actuator operatively connected to the second roller for moving the second roller between the first position and the second position;

a third roller rotationally connected to the frame, the third roller being disposed vertically lower than the first and second rollers;

a motor operatively connected to one of the first, second and third rollers for rotating the one of the first, second and third rollers;

a controller in communication with the motor and the actuator for controlling the motor and the actuator;

an endless belt wrapped around the first, second and third rollers, and a napkin delivery assembly for delivering the napkin to the endless belt, the napkin delivery assembly including a fan for picking up the napkin from a stack of napkins and being movable between the stack of napkins and the endless belt;

in an initial configuration of the first, second and third rollers:

the second roller is in the first position, the endless belt is in tension about the first, second, and third rollers, and a portion of the endless belt extending between the first and second rollers defines a flat surface for receiving the napkin and the at least one utensil thereon;

in a wrapping configuration of the first, second and third rollers:

the second roller is in the second position, and the portion of the endless belt extending between the first and second rollers extends generally downward from the first roller to a low point and extends generally upward from the low point to the second roller for receiving the napkin and the at least one utensil at the low point such that rotation of the one of the first, second and third rollers by the motor causes the endless belt to turn around the first, second and third rollers thereby wrapping the napkin around the at least one utensil, and the controller being programmed for consecutively:

controlling the actuator for placing the first, second and third rollers in the initial configuration;

controlling the actuator for placing the first, second and third rollers in the wrapping configuration;

controlling the motor to rotate the one of the first, second and third rollers for turning the endless belt around the first, second and third rollers;

controlling the motor to stop rotating the one of the first, second and third rollers; and controlling the actuator for placing the first, second and third rollers in the initial configuration.

10. The apparatus of claim 9, wherein the motor is operatively connected to the third roller for rotating the third roller.

11. The apparatus of claim 9, wherein the second roller is movable between the first and second positions along a rectilinear path.

12. The apparatus of claim 9, wherein:

the motor is a first motor; and the actuator is a second motor.

13. The apparatus of claim 9, further comprising a utensil delivery assembly for delivering the at least one utensil to the endless belt.

14. The apparatus of claim 13, wherein the utensil delivery assembly comprises:

at least one magazine for storing a plurality of utensils; and a utensil picker having a magnet for picking up at least one utensil from the at least one magazine with the magnet and delivering the at least one utensil to the endless belt.

15. The apparatus of claim 9, wherein the first roller rotates about an axis of rotation that is fixed relative to the frame.

16. An apparatus for wrapping a napkin around at least one utensil comprising:

a frame;

a first roller rotationally connected to the frame;

a second roller rotationally connected to the frame, the second roller being movable between a first position and a second position, in the first position the second roller being generally vertically aligned with the first roller, the second roller being closer to the first roller in the second position than in the first position in a horizontal direction;

an actuator operatively connected to the second roller for moving the second roller between the first position and the second position;

a third roller rotationally connected to the frame, the third roller being disposed vertically lower than the first and second rollers;

a motor operatively connected to one of the first, second and third rollers for rotating the one of the first, second and third rollers;

a controller in communication with the motor and the actuator for controlling the motor and the actuator;

an endless belt wrapped around the first, second and third rollers, and a utensil delivery assembly for delivering the at least one utensil to the endless belt, the utensil delivery assembly including:

at least one magazine for storing a plurality of utensils; and a utensil picker having a magnet for picking up at least one utensil from the at least one magazine with the magnet and delivering the at least one utensil to the endless belt, in an initial configuration of the first, second and third rollers:

the second roller is in the first position, the endless belt is in tension about the first, second, and third rollers, and a portion of the endless belt extending between the first and second rollers defines a flat surface for receiving the napkin and the at least one utensil thereon;

in a wrapping configuration of the first, second and third rollers:

the second roller is in the second position, and the portion of the endless belt extending between the first and second rollers extends generally downward from the first roller to a low point and extends generally upward from the low point to the second roller for receiving the napkin and the at least one utensil at the low point such that rotation of the one of the first, second and third rollers by the motor causes the endless belt to turn around the first, second and third rollers thereby wrapping the napkin around the at least one utensil, and the controller being programmed for consecutively:

controlling the actuator for placing the first, second and third rollers in the initial configuration;

controlling the actuator for placing the first, second and third rollers in the wrapping configuration;

controlling the motor to rotate the one of the first, second and third rollers for turning the endless belt around the first, second and third rollers;

controlling the motor to stop rotating the one of the first, second and third rollers; and controlling the actuator for placing the first, second and third rollers in the initial configuration.

17. The apparatus of claim 16, wherein the motor is operatively connected to the third roller for rotating the third roller.

18. The apparatus of claim 16, wherein the second roller is movable between the first and second positions along a rectilinear path.

19. The apparatus of claim 16, further comprising a napkin delivery assembly for delivering the napkin to the endless belt.

20. The apparatus of claim 16, wherein the first roller rotates about an axis of rotation that is fixed relative to the frame.

* * * * *